US011657948B2

(12) United States Patent
Morinaga

(10) Patent No.: US 11,657,948 B2
(45) Date of Patent: May 23, 2023

(54) WIRE-WOUND CORE, WIRE-WOUND CORE MANUFACTURING METHOD, AND WIRE-WOUND-EQUIPPED ELECTRONIC COMPONENT

(71) Applicant: Murata Manufacturing Co., Ltd., Kyoto-fu (JP)

(72) Inventor: Tetsuya Morinaga, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 1267 days.

(21) Appl. No.: 16/152,290

(22) Filed: Oct. 4, 2018

(65) Prior Publication Data

US 2019/0115140 A1 Apr. 18, 2019

(30) Foreign Application Priority Data

Oct. 12, 2017 (JP) ..... JP2017-198306

(51) Int. Cl.
*H01F 17/04* (2006.01)
*H01F 27/245* (2006.01)
(Continued)

(52) U.S. Cl.
CPC ..... *H01F 27/245* (2013.01); *H01F 17/045* (2013.01); *H01F 27/2823* (2013.01);
(Continued)

(58) Field of Classification Search
CPC ..... H01F 27/2823
(Continued)

(56) References Cited

U.S. PATENT DOCUMENTS 4,949,221 A * 8/1990 Rollins ..... H05K 3/3431 361/807
10,418,174 B2 9/2019 Mikogami et al.
(Continued)

FOREIGN PATENT DOCUMENTS

JP H0572111 U 9/1993
JP H11329852 A 11/1999
(Continued)

OTHER PUBLICATIONS

An Office Action mailed by the Japanese Patent Office dated Mar. 31, 2020, which corresponds to Japanese Patent No. 2017-198306 and is related to U.S. Appl. No. 16/152,290 with English language translation.
(Continued)

*Primary Examiner* — Ronald Hinson
(74) *Attorney, Agent, or Firm* — Studebaker & Brackett PC

(57) ABSTRACT

A wire-wound core includes a core portion extending in a longitudinal direction, first and second flange portions respectively disposed at first and second end portions of the core portion in the longitudinal direction, and at least one terminal electrode disposed at each of the first and second flange portions. When a face to be oriented toward a mount board and a face of the first flange portion facing an outer side are respectively called a bottom surface and an outer end surface, the outer end surface has a recessed portion that reaches the bottom surface. The terminal electrode disposed at the first flange portion includes a bottom surface electrode portion formed of a film conductor extending along the bottom surface of the first flange portion and an end surface electrode portion formed of a conductor filling the recessed portion and being in contact with the bottom surface electrode portion.

20 Claims, 16 Drawing Sheets

(51) Int. Cl.

| | |
|---|---|
| ***H01F 27/28*** | (2006.01) |
| ***H01F 27/40*** | (2006.01) |
| ***H01F 41/02*** | (2006.01) |
| ***H01F 27/29*** | (2006.01) |

(52) U.S. Cl.
CPC ..... *H01F 27/29* (2013.01); *H01F 27/292* (2013.01); *H01F 27/40* (2013.01); *H01F 41/0233* (2013.01); *H01F 41/0246* (2013.01)

(58) Field of Classification Search
USPC ..... 336/221
See application file for complete search history.

(56) References Cited

U.S. PATENT DOCUMENTS

| | | | |
|---|---|---|---|
| 2002/0005567 | A1 | 1/2002 | Sakai et al. |
| 2006/0215349 | A1 | 9/2006 | Lee et al. |
| 2010/0109827 | A1 | 5/2010 | Asou et al. |
| 2017/0179915 | A1 | 6/2017 | Guan |
| 2018/0211763 | A1* | 7/2018 | Komaya ..... H01F 27/2828 |

FOREIGN PATENT DOCUMENTS

| | | | |
|---|---|---|---|
| JP | 2002026513 | A | 1/2002 |
| JP | 2003-243226 | A | 8/2003 |
| JP | 2005-136009 | A | 5/2005 |
| JP | 2006140254 | A | 6/2006 |
| JP | 2006270047 | A | 10/2006 |
| JP | 2010109267 | A | 5/2010 |
| JP | 2012104547 | A | 5/2012 |
| JP | 2017-017288 | A | 1/2017 |
| WO | 2016051853 | A1 | 4/2016 |

OTHER PUBLICATIONS

An Office Action mailed by the Japanese Patent Office dated Aug. 21, 2020, which corresponds to Japanese Patent Application No. 2017-198306 and is related to U.S. Appl. No. 16/152,290 with English language translation.

An Office Action; "Notification of Reasons for Refusal," Mailed by the Japanese Patent Office dated Nov. 19, 2019, which corresponds to Japanese Patent Application No. 2017-198306 and is related to U.S. Patent Application Mo. U.S. Appl. No. 16/152,290; with English language translation.

* cited by examiner

WIRE-WOUND CORE, WIRE-WOUND CORE MANUFACTURING METHOD, AND WIRE-WOUND-EQUIPPED ELECTRONIC COMPONENT

CROSS-REFERENCE TO RELATED APPLICATION

This application claims benefit of priority to Japanese Patent Application No. 2017-198306, filed Oct. 12, 2017, the entire content of which is incorporated herein by reference.

BACKGROUND

Technical Field

The present disclosure relates to a wire-wound core, a wire-wound core manufacturing method, and a wire-wound-equipped electronic component including a wire-wound core and, more particularly, to improvements in a configuration of a terminal electrode disposed on the wire-wound core and in a terminal electrode formation method.

Background Art

For example, a technique described in Japanese Unexamined Patent Application Publication No. 2003-243226 aims to provide a wire-wound-type electronic component that makes mass production of a core easier, has small variations in inductance, and has stable fixation strength on a printed circuit board when being mounted on the printed circuit board and to provide a manufacturing method of such a wire-wound-type electronic component. To this end, a following configuration is described in Japanese Unexamined Patent Application Publication No. 2003-243226.

A core having a substantially quadrangular shape is obtained by cutting a sheet formed of a magnetic material or a non-magnetic material in length and width directions. Terminal electrodes are disposed on respective end portions of a bottom surface of the core. Recessed portions having a depth greater than a thickness of a wound wire are respectively formed by cutting on a portion of the bottom surface of the core between the terminal electrodes and on a top surface of the core. A part of a wound wire is accommodated in the recessed portions. In addition, ends of the wound wire are fixed to the respective terminal electrodes.

To increase the reliability of electrical connection and mechanical fixation of an electronic component including a core described above when the electronic component is mounted on a mount board, wider soldered areas of the terminal electrodes are more desirable. More specifically, the terminal electrodes are desirably formed not only on the bottom surface of the core to be oriented toward the mount board when the electronic component is mounted on the mount board but also on outer end surfaces that face respective outer sides of the core.

On the other hand, according to Japanese Unexamined Patent Application Publication No. 2003-243226, the terminal electrodes are formed on a sheet before each core is cut therefrom to increase mass productivity. More specifically, it is described in Japanese Unexamined Patent Application Publication No. 2003-243226 that the terminal electrodes are formed by stacking a conductor green sheet containing conductive power together with insulator green sheets (paragraphs 0044 to 0046), by applying and baking a conductor paste (paragraph 0067), or by using a copper-fixed sheet (paragraph 0069).

Since the terminal electrodes described in Japanese Unexamined Patent Application Publication No. 2003-243226 are formed on a sheet before each core is cut therefrom using one of the aforementioned methods, the terminal electrodes have a film shape that extends along only the bottom surface of the core. That is, since the outer end surfaces of the core are surfaces that appear by cutting the sheet, terminal electrodes that extend from the bottom surface to the outer end surfaces of the core cannot be formed using the method described in Japanese Unexamined Patent Application Publication No. 2003-243226 as long as the terminal electrodes are formed on the sheet before each core is cut therefrom.

Note that substantially the same advantage as that obtained by terminal electrodes that extend from the bottom surface to the outer end surfaces of the core may be obtained even with terminal electrodes that extend only along the bottom surface of the core if the thickness of the terminal electrodes is increased. However, there is a limit in terms of increasing the thickness of the terminal electrodes. In practice, it is almost impossible to expect substantially the same advantage as that obtained by the terminal electrodes extending from the bottom surface to the outer end surfaces of the core. In addition, an eddy current loss due to magnetic flux linkage increases as the thickness of the terminal electrodes increases, resulting in degradation of characteristics.

In addition, paragraph 0067 of Japanese Unexamined Patent Application Publication No. 2003-243226 describes that the terminal electrodes may be formed by applying and baking a conductor paste after each core is cut from the sheet. However, it is easily presumed that this method is inferior in terms of mass productivity and becomes more difficult to carry out as the size of the core decreases.

In addition, when a conductor paste is applied as described above, a dip method is usually used. In this case, since the conductor paste is applied to four lateral surfaces that are adjacent to the bottom surface of the core, that is, two lateral surfaces, an inner end surface, and an outer end surface, the height of the electrode portion that can be formed on the end surface is limited because the electrode portion formed on the inner end surface needs to have a height that does not touch the wound wire wound around a core portion such as the recessed portions of Japanese Unexamined Patent Application Publication No. 2003-243226.

The height of the electrode portion can be increased only on the outer end surface by diagonally dipping the core to the conductor paste. However, since end portions of the core need to be dipped separately in this case, mass productivity further decreases.

SUMMARY

Accordingly, this disclosure provides a wire-wound core manufacturing method that enables fabrication of a wire-wound core including terminal electrodes extending from a bottom surface to outer end surfaces at a high productivity also in the case where the size of the wire-wound core decreases and a wire-wound core fabricated using this method.

This disclosure also provides a wire-wound-equipped electronic component including the aforementioned wire-wound core.

According to preferred embodiments of the present disclosure, a wire-wound core includes a core portion having a longitudinal direction, a first flange portion disposed at a first end portion of the core portion in the longitudinal direction, a second flange portion disposed at a second end portion of the core portion in the longitudinal direction, a terminal electrode disposed at the first flange portion, and a terminal electrode disposed at the second flange portion. When a face to be oriented toward a mount board when the wire-wound core is mounted on the mount board is defined as a bottom surface and a face of the first flange portion that faces an outer side opposite to a side where the core portion is located is defined as an outer end surface, the outer end surface has a recessed portion that reaches the bottom surface of the first flange portion.

The terminal electrode disposed at the first flange portion includes a bottom surface electrode portion that is formed of a film conductor extending along the bottom surface of the first flange portion and an end surface electrode portion that is formed of a conductor filling the recessed portion and is in contact with the bottom surface electrode portion. Note that the end surface electrode portion that is continuous to the bottom surface electrode portion is not limited to the end surface electrode portion that is integrated with the bottom surface electrode portion and may be just in contact with the bottom surface electrode portion as a separate portion.

The above-described terminal electrode can be easily and efficiently formed on the wire-wound core if a manufacturing method described later is used.

In addition, when a face opposite to the bottom surface is defined as a top surface, the top surface of the core portion and the top surface of the first flange portion may be flush with each other or the top surface of the core portion may be lower than the top surface of the first flange portion. The state in which the top surface of the core portion is lower than the top surface of the first flange portion is, in other words, a state in which the top surface of the core portion is located closer to the mount board than the top surface of the first flange portion.

In addition, when a face opposite to the bottom surface is defined as a top surface and a face linking the bottom surface and the top surface to each other is defined as a lateral surface, the lateral surface of the core portion and the lateral surface of the first flange portion may be flush with each other or the lateral surface of the core portion may be lower than the lateral surface of the first flange portion. The state in which the lateral surface of the core portion is lower than the lateral surface of the first flange portion is, in other words, a state in which the lateral surface of the core portion is located closer to the central axis of the core portion than the lateral surface of the first flange portion.

In addition, the outer end surface and an end surface of the end surface electrode portion that faces the outer side may be flush with each other. In addition, when a face opposite to the bottom surface is defined as a top surface, an end portion of the recessed portion on a top surface side may be a flat surface parallel to the top surface of the first flange portion.

When a face opposite to the bottom surface is defined as a top surface and a face linking the bottom surface and the top surface to each other is defined as a lateral surface, the bottom surface electrode portion may reach the lateral surface of the first flange portion and the end surface electrode portion may be located on an inner side than the lateral surface of the first flange portion. In addition, the wire-wound core may further include a plurality of terminal electrodes each being the terminal electrode disposed at the first flange portion, and the plurality of terminal electrodes may be arranged in a direction that is perpendicular to the longitudinal direction and is parallel to the bottom surface.

In addition, the wire-wound core may further include a passive element that is connected to the plurality of terminal electrodes and is included in the first flange portion. For example, in the case where the passive element is a capacitor, a filter having a good noise removal effect, such as a $\pi$ filter or a T filter, can be implemented using this wire-wound core. In addition, when a perpendicular bisector plane of a central axis extending in the longitudinal direction of the core portion is defined as a symmetry plane, the terminal electrode disposed at the first flange portion and the terminal electrode disposed at the second flange portion may be symmetrical or asymmetrical about the symmetry plane.

A wire-wound core manufacturing method described later is applicable to the various embodiments described above, and the wire-wound core can be easily manufactured even if the size of the wire-wound core decreases. In addition, according to preferred embodiments of the present disclosure, a wire-wound-equipped electronic component includes the wire-wound core described above, and a wire that is wound around the core portion of the wire-wound core, the wire having ends electrically connected to the respective terminal electrodes.

Further, according to preferred embodiments of the present disclosure, a wire-wound core manufacturing method for manufacturing the wire-wound core described above, includes creating a mother block in which a plurality of first mother sheets and a plurality of second mother sheets are stacked in this order, the plurality of first mother sheets being formed of a non-conductive material, and the plurality of second mother sheets being formed of a non-conductive material and having a plurality of through-holes each of which serves as the recessed portion. The method further includes forming a first groove on the mother block from a second mother sheet side to form a face serving as the bottom surface of the core portion in the mother block; and dividing the mother block along a plurality of x-direction division planes perpendicular to the bottom surface and a plurality of y-direction division planes perpendicular to the bottom surface to locate each of the plurality of through-holes on a corresponding outer end surface side.

In addition, in the step of creating the mother block, a conductor serving as the end surface electrode portion may be disposed in each of the plurality of through-holes. In addition, the step of creating the mother block may include forming the plurality of first mother sheets by printing, and forming the plurality of second mother sheets on the plurality of first mother sheets by printing.

In addition, in the step of creating the mother block, a conductor film serving as the bottom surface electrode portion may be disposed on a bottom surface of the second mother sheet located on a bottommost side among the plurality of second mother sheets, and the conductor film may be divided by either the x-direction division planes or the y-direction division planes. In this case, the bottom surface electrode portion reaches the lateral surface of the first flange portion.

In addition, the wire-wound core manufacturing method may further include forming, when a face opposite to the bottom surface is defined as a top surface and a face linking the bottom surface and the top surface to each other is defined as a lateral surface, through-holes in the first mother sheets and the second mother sheets to make the lateral surface of the core portion lower than the lateral surface of the first flange portion. In addition, the wire-wound core manufacturing method may further include forming, when a face opposite to the bottom surface is defined as a top surface, a second groove on the mother block from a top surface side to make the top surface of the core portion lower than the top surface of the first flange portion. In addition, the wire-wound core manufacturing method may further include forming a pattern conductor of a passive element on at least one of the pluralities of first and second mother sheets.

The wire-wound core according to the preferred embodiments of this disclosure includes the terminal electrode extending from the bottom surface to the outer end surface of the first flange portion. Thus, the reliability of electrical connection and mechanical fixation in the mounted state is successfully increased.

With the wire-wound core manufacturing method according to the preferred embodiments of this disclosure, the wire-wound core is fabricated roughly by creating a mother block in which a plurality of mother sheets, some of which have through-holes, are stacked, by forming a groove on the mother block, and by dividing the mother block.

The recessed portion can be efficiently formed with a high preciseness by forming through-holes in each of the mother sheets constituting the mother block before obtaining the mother block and by dividing the mother block to locate each of the through-holes on the corresponding outer end surface side even if the size of the wire-wound core decreases. That is, the reduction in size of the wire-wound core can be well handled by disposing a conductor serving as the end surface electrode portion in this recessed portion, compared with the case where a wire-wound core having an end surface electrode portion is obtained by molding using a die, for example. In addition, the terminal electrode extending from the bottom surface to the outer end surface of the flange portion can be efficiently formed with a high preciseness. In addition, the core portion can be efficiently formed with a high preciseness by forming the groove on the mother block.

In addition, most of steps for obtaining the wire-wound core are finished before dividing the mother block. Thus, division of the mother block enables many wire-wound cores to be obtained simultaneously and thus implements high productivity. In addition, the number of wire-wound cores obtained from a single mother block increases as the size of wire-wound cores to be obtained decreases. Thus, a decrease in cost of the wire-wound cores is expected.

In addition, processing conditions of formation of the through-holes in the mother sheets, formation of the groove on the mother block, and division of the mother block are changeable by changing the respective processing programs. Thus, various design changes can be quickly handled since re-fabrication of a die is not necessary, for example.

Other features, elements, characteristics and advantages of the present disclosure will become more apparent from the following detailed description of preferred embodiments of the present disclosure with reference to the attached drawings.

BRIEF DESCRIPTION OF THE DRAWINGS

FIG. 21A is a sectional view taken along line A-A in FIG. 20, and FIG. 21B is a sectional view taken along line B-B in FIG. 20;

FIG. 22A illustrates the second mother sheet that provides a section taken along line C-C in FIG. 21A, and FIG. 22B illustrates the second mother sheet that provides a section taken along line D-D in FIG. 21B;

DETAILED DESCRIPTION

First Embodiment

Figure 1:
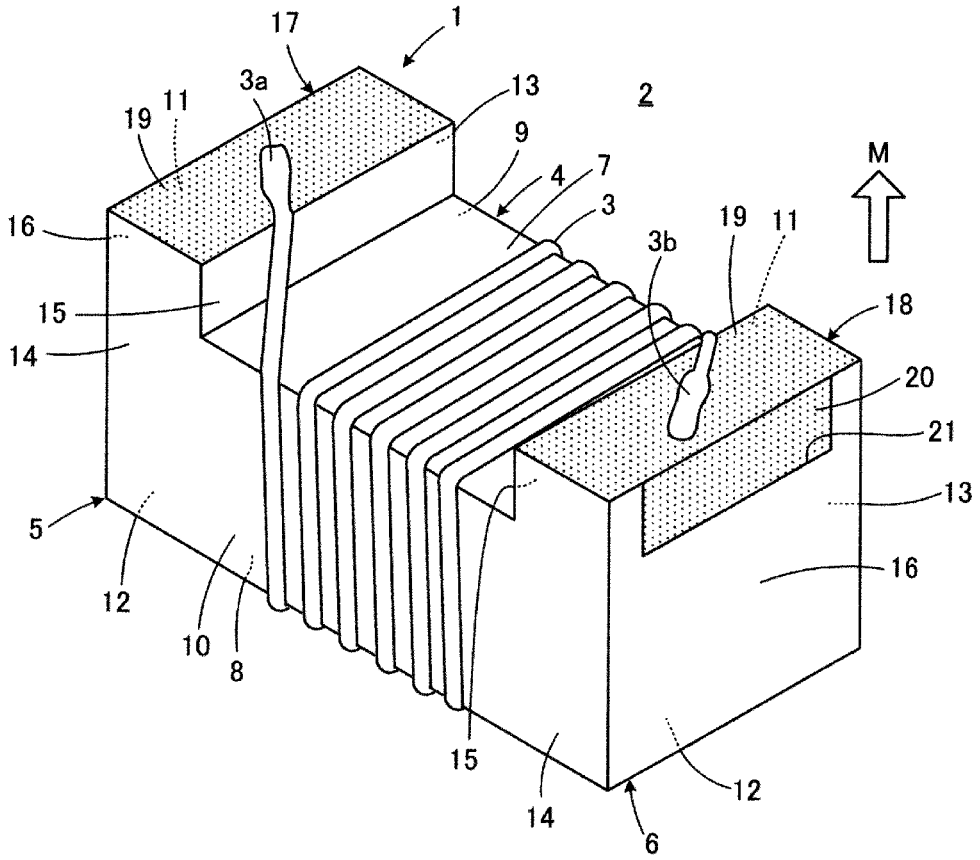
FIG. 1 is a perspective view illustrating an external appearance of a wire-wound-equipped electronic component including a wire-wound core according to a first embodiment of this disclosure with a face to be oriented toward a mount board facing upward.

A wire-wound-equipped electronic component 2 including a wire-wound core 1 according to a first embodiment of this disclosure will be described first with reference to FIG. 1. FIG. 1 illustrates the wire-wound-equipped electronic component 2 with a bottom surface thereof to be oriented toward a mount board facing upward. The wire-wound-equipped electronic component 2 illustrated in FIG. 1 constitutes a coil component having a single coil, for example.

The wire-wound core 1 included in the wire-wound-equipped electronic component 2 includes a core portion 4 where a wound wire 3 is disposed, a first flange portion 5, a second flange portion 6, a first terminal electrode 17, and a second terminal electrode 18. The core portion 4 has a longitudinal direction. The first flange portion 5 and the second flange portion 6 are respectively located at a first end portion and a second end portion that are opposite to each other in the longitudinal direction of the core portion 4.

The wire-wound core 1 is formed of a non-conductive material, more specifically, a non-magnetic material such as alumina, a magnetic material such as ferrite, glass, or a resin. The wire-wound core 1 is preferably formed of a ceramic material such as alumina or ferrite or of glass in the case where the wire-wound core 1 is fabricated using a manufacturing method described later.

A section of each of the core portion 4, the first flange portion 5, and the second flange portion 6 taken along a plane that is perpendicular to the longitudinal direction of the core portion 4 has a substantially quadrangular shape. Thus, when a face to be oriented toward a mount board M when the wire-wound core 1 is mounted is defined as a bottom surface, the core portion 4 includes a core-portion bottom surface 7 which is the bottom surface of the core portion 4, a core-portion top surface 8 which is the top surface located on the side opposite to the core-portion bottom surface 7, a first core-portion lateral surface 9, and a second core-portion lateral surface 10. The first core-portion lateral surface 9 and the second core-portion lateral surface 10 are lateral surfaces linking the core-portion bottom surface 7 and the core-portion top surface 8, and extend in the linking direction and face opposite lateral directions.

In each of the first flange portion 5 and the second flange portion 6, a face that is located on a side opposite to the core portion 4 side and that faces outward is defined as an outer end surface 16. More specifically, each of the first flange portion 5 and the second flange portion 6 includes a flange-portion bottom surface 11, a flange-portion top surface 12, a first flange-portion lateral surface 13, a second flange-portion lateral surface 14, an inner end surface 15, and the outer end surface 16. The flange-portion bottom surface 11 is oriented toward the mount board M as a bottom surface when the wire-wound core 1 is mounted and is located closer to the mount board M than the core-portion bottom surface 7. The flange-portion top surface 12 is a top surface located on a side opposite to the flange-portion bottom surface 11. The first flange-portion lateral surface 13 and the second flange-portion lateral surface 14 extend as lateral surfaces in a direction perpendicular to the mount board M, link the flange-portion bottom surface 11 and the flange-portion top surface 12 to each other, and face opposite lateral directions. The inner end surface 15 is one of end portions of the core portion 4 that faces the core portion 4. The outer end surface 16 faces outward opposite to the inner end surface 15. The outer end surface 16 has a recessed portion 21 that reaches the flange-portion bottom surface 11.

Although not illustrated, ridge portions and corner portions on the external shape of the wire-wound core 1 are preferably R-chamfered. Thus, the aforementioned quadrangular shapes of the sections of the core portion 4, the first flange portion 5, and the second flange portion 6 include such R-chamfered shapes, C-chamfered shapes, and shapes having a slightly uneven surface or a curved surface.

The first flange portion 5 and the second flange portion 6 respectively have the first terminal electrode 17 and the second terminal electrode 18. Each of the first terminal electrode 17 and the second terminal electrode 18 includes a bottom surface electrode portion 19 formed along the flange-portion bottom surface 11 and an end surface electrode portion 20 formed along the outer end surface 16. The bottom surface electrode portion 19 is formed of a film conductor extending along the flange-portion bottom surface 11. The end surface electrode portion 20 is formed of a conductor that fills the recessed portion 21 and is in contact with the bottom surface electrode portion 19.

Although not illustrated in FIG. 1, the end surface electrode portion 20 formed along the outer end surface 16 of the first flange portion 5 has substantially the same shape as the end surface electrode portion 20 formed along the outer end surface 16 of the second flange portion 6. The first terminal electrode 17 and the second terminal electrode 18 are formed of a conductor that contains a metal such as silver, gold, copper, or nickel as a conductive component, for example.

The wound wire 3 is formed of a copper wire coated with a resin insulator of polyurethane or polyimide, for example. The wound wire 3 is helically wound around the core portion 4. A first end 3*a* of the wound wire 3 is connected to the first terminal electrode 17, and a second end 3*b* opposite to the first end 3*a* of the wound wire 3 is connected to the second terminal electrode 18. For example, heat-pressure crimping is used to connect the wound wire 3 to the first terminal electrode 17 and the second terminal electrode 18.

As described above, the flange-portion bottom surface 11 is located closer to the mount board M than the core-portion bottom surface 7. In other words, the flange-portion bottom surface 11 is located at a higher position than the core-portion bottom surface 7. Thus, the wound wire 3 is successfully configured not to protrude to outside of the first flange portion 5 and the second flange portion 6 on the mount board M side. Thus, the wound wire 3 is successfully protected from stress applied from the mount board M side. In addition, a predetermined distance or more can be provided between the wound wire 3 and solder applied to the first terminal electrode 17 and the second terminal electrode 18 when the wire-wound core 1 is mounted. Consequently, an undesirable influence of adhesion of the solder to the wound wire 3 on the wound wire 3 is successfully avoided.

A manufacturing method of the wire-wound core 1 illustrated in FIG. 1 will be described next with reference to FIGS. 2 to 9.

Figure 2:
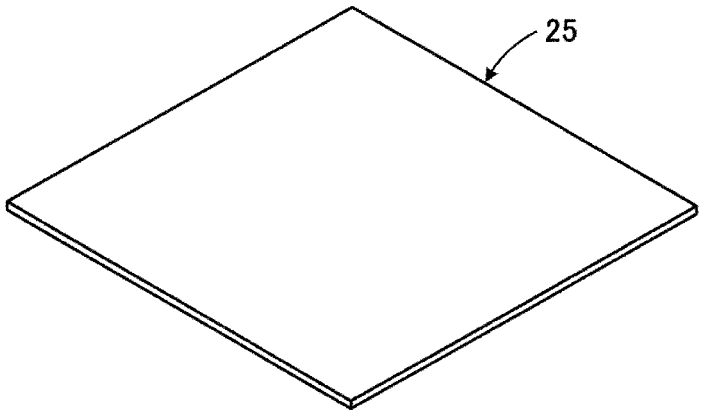
FIG. 2 is a perspective view illustrating an unprocessed mother sheet prepared for fabrication of the wire-wound core illustrated in FIG. 1.

First, as illustrated in FIG. 2, an unfired mother sheet 25 is prepared, which is obtained by shaping a slurry containing a non-conductive material, for example, a ceramic material such as alumina or ferrite, into a sheet. At this stage, the mother sheet 25 is not processed at all.

Figure 3:
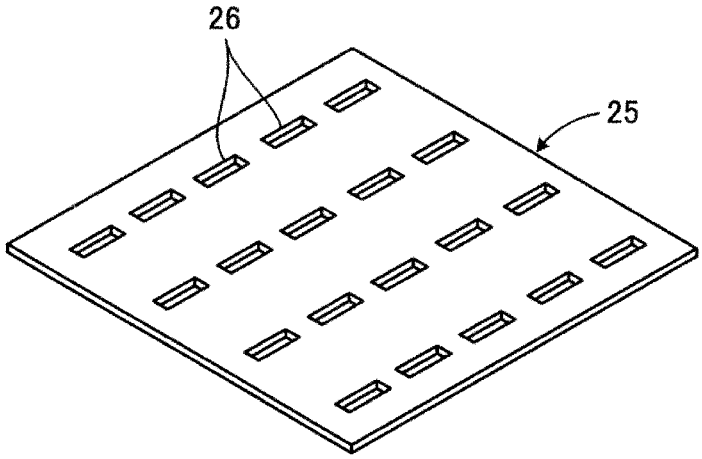
FIG. 3 is a perspective view illustrating a state in which a plurality of through-holes are formed in the unprocessed mother sheet illustrated in FIG. 2.

Then, as illustrated in FIG. 3, through-holes 26 are formed at portions of the mother sheet 25. The through-holes 26 provide the recessed portions 21 in which respective conductors serving as the end surface electrode portions 20 of the first terminal electrode 17 and the second terminal electrode 18 described above are disposed. The plurality of through-holes 26 are arranged to form rows and columns in a plane direction of the mother sheet 25. The through-holes 26 have, for example, a shape of quadrangular openings and are formed by using die-cut processing or laser processing on the mother sheet 25.

Figure 4:
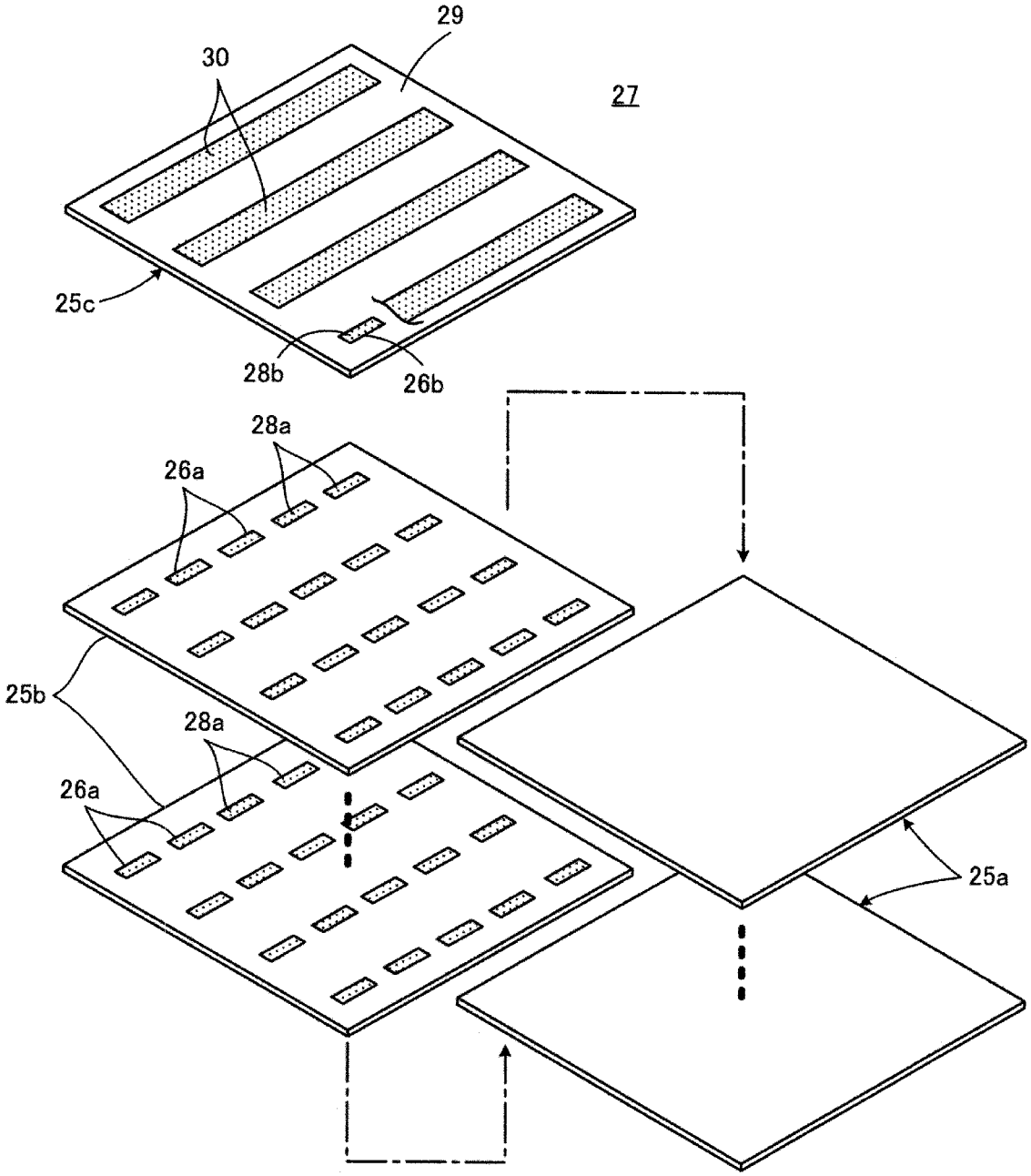
FIG. 4 is a perspective view illustrating a staking order of first to third mother sheets that are stacked to obtain a mother block.

Then, a step of stacking the mother sheets is performed. FIG. 4 illustrates, in a stacking order, first mother sheets 25*a*, second mother sheets 25*b*, and a third mother sheet 25*c* that are stacked to obtain a mother block 27 illustrated in FIG. 5.

Referring to FIG. 4, each of the first mother sheets 25*a* is the mother sheet 25 illustrated in FIG. 2. The first mother sheets 25*a* have no through-holes 26. A predetermined number of first mother sheets 25*a* are consecutively stacked.

A plurality of first through-holes 26*a* are formed in each of the second mother sheets 25*b* that are stacked on the first mother sheets 25*a*. First conductors 28*a* are disposed in the respective first through-holes 26*a*. For example, the first conductor 28*a* is formed of a conductive paste with which each of the first through-holes 26*a* is filled by printing. For example, a conductive paste containing a metal, such as silver, gold, copper, or nickel as a conductive component is used as the conductive paste. The conductive paste having substantially the same composition is used as each conductive paste to be recited in the following description.

Each of the second mother sheets 25*b* is created using the mother sheet 25 illustrated in FIG. 3. The through-holes 26 of the mother sheet 25 illustrated in FIG. 3 are used as the first through-holes 26*a* of the second mother sheet 25*b*. The first through-holes 26*a* serve as the respective recessed portions 21 that define the respective end surface electrode portions 20 of the first terminal electrode 17 and the second terminal electrode 18. The first conductors 28*a* serve as the respective end surface electrode portions 20. A predetermined number of second mother sheets 25*b* are consecutively stacked.

Note that the first through-holes 26*a* of the second mother sheets 25*b* may be formed collectively in the plurality of mother sheets 25 after the plurality of mother sheets 25 illustrated in FIG. 2 are stacked together. In addition, the plurality of first through-holes 26*a* that are regularly arranged in the plurality of second mother sheets 25*b* that are stacked together may be collectively filled with the conductive paste that serves as the first conductors 28*a*.

The third mother sheet 25*c* is stacked on the second mother sheets 25*b* with a first principal surface 29 of the third mother sheet 25*c* being oriented outward. The third mother sheet 25 has a plurality of conductor films 30 formed in a strip pattern on the first principal surface 29. The third mother sheet 25*c* is equivalent to the second mother sheet 25*b* that has the conductor films 30 on the bottom surface side and that is to be located on the bottommost side. That is, second through-holes 26*b* are formed in the third mother sheet 25*c* as illustrated by removing a portion of the conductor film 30 located on the right end in FIG. 4 and second conductors 28*b* are disposed in the respective second through-holes 26*b*.

For example, the second conductors 28*b* are formed of a conductive paste with which the respective second through-holes 26*b* are filled by printing just like the first conductors 28*a*. In addition, the conductor films 30 are formed by printing a conductive paste, for example. Note that filling of the second through-holes 26*b* with the conductive paste serving as the second conductors 28*b* is preferably performed simultaneously with printing of the conductive paste forming the conductor films 30.

Figure 5:
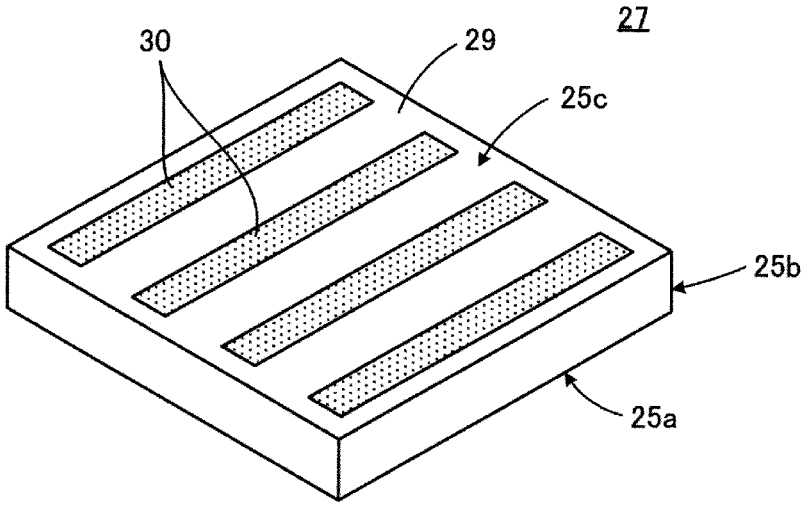
FIG. 5 is a perspective view illustrating the mother block obtained by stacking the first to third mother sheets illustrated in FIG. 4.

Through the above-described stacking step, the mother block 27 illustrated in FIG. 5 is created. The mother block 27 is pressed in the stacking direction if necessary.

Figure 6:
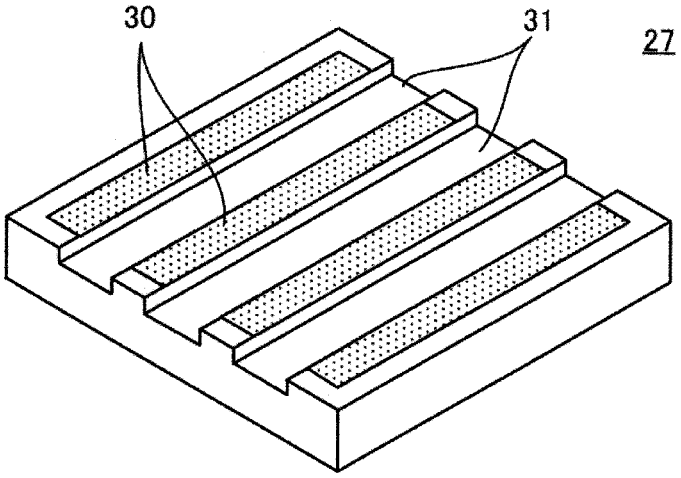
FIG. 6 is a perspective view illustrating a state in which first grooves are formed on the mother block illustrated in FIG. 5.

Then, as illustrated in FIG. 6, a step of forming a plurality of first grooves 31 on the mother block 27 from the second mother sheet 25*b* side, that is, from the first principal surface 29 side of the third mother sheet 25*c*, is performed to form faces that serve as the core-portion bottom surfaces 7 (see FIG. 1) of the core portions 4 in the mother block 27. The first grooves 31 are formed in respective regions between the plurality of conductor films 30 formed in a stripe pattern. The first grooves 31 are formed by cutting processing using a dicer, for example. The diameter of the core portions 4 is appropriately changeable by changing the depth of the first grooves 31. This can contribute to an improvement in the preciseness of the dimensions of the core portion 4.

Figure 7:
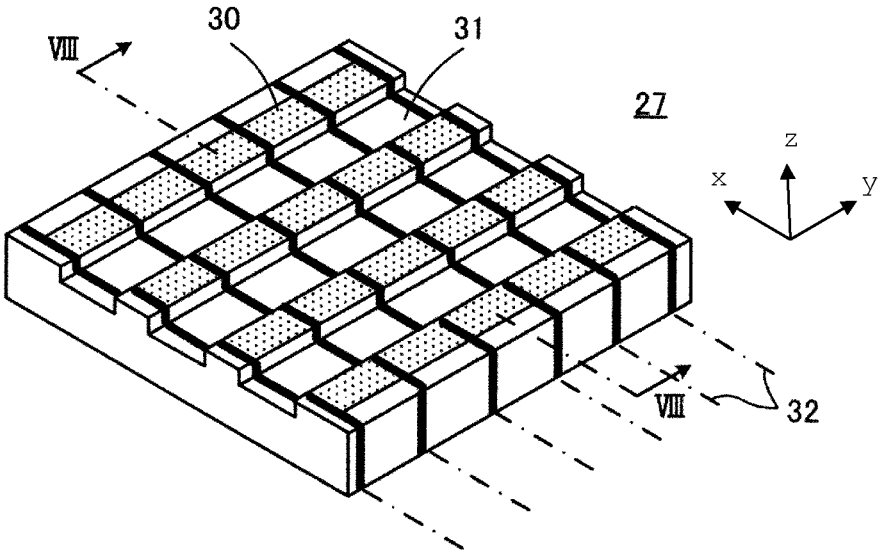
FIG. 7 is a perspective view illustrating a state in which the mother block illustrated in FIG. 6 is divided along x-direction division planes.
Figure 8:
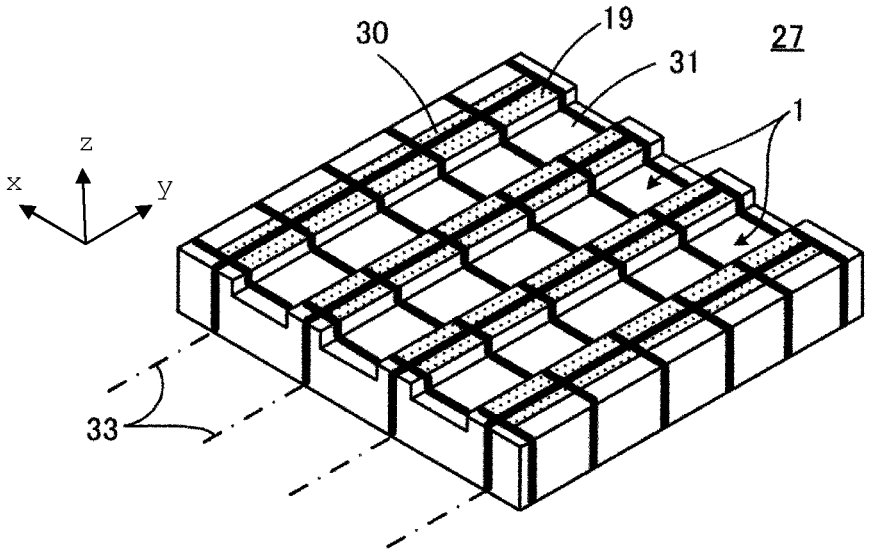
FIG. 8 is a perspective view illustrating a state in which the mother block illustrated in FIG. 7 is further divided along y-direction division planes.

Then, as illustrated in FIGS. 7 and 8, the mother block 27 is divided along a plurality of x-direction division planes 32 and a plurality of y-direction division planes 33 that are perpendicular to the bottom surface of the mother block 27 to locate the plurality of first through-holes 26*a* on the respective outer end surface 16 sides and to obtain the plurality of wire-wound cores 1. In this embodiment, the mother block 27 is divided along the x-direction division planes 32 first as illustrated in FIG. 7. Then, the mother block 27 is divided along the y-direction division planes 33 as illustrated in FIG. 8. As indicated by this step, locating the first through-holes 26*a* on the respective outer end surface 16 sides refers to dividing the mother block 27 so that each of the first through-holes 26*a* is located at the outer end of the resultant second mother sheets 25*b* regardless of the presence or absence of the first conductor 28*a*.

Figure 9:
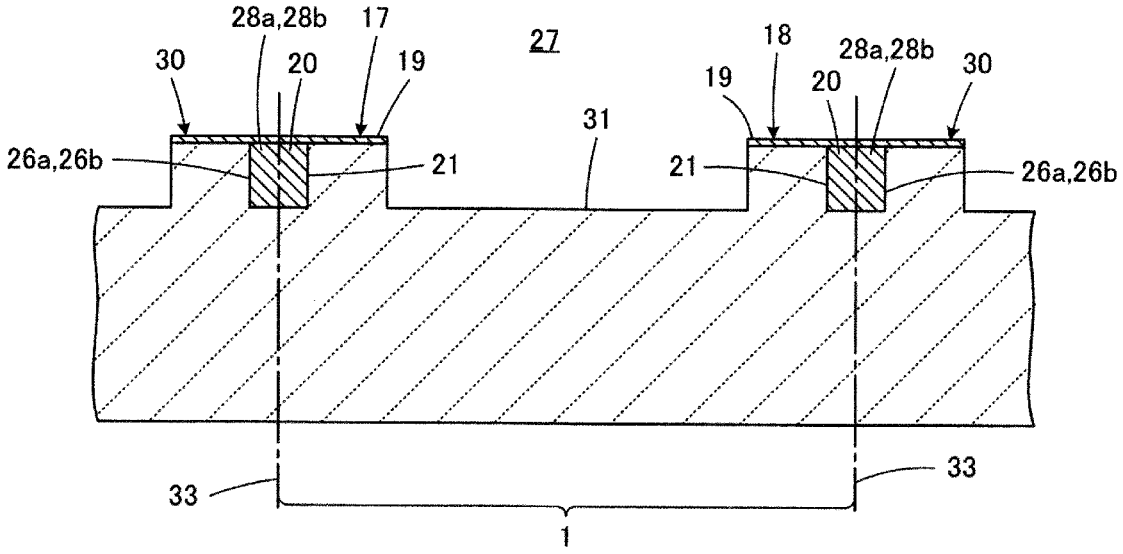
FIG. 9 is a partially enlarged sectional view of the mother block illustrated in FIG. 7 taken along line VIII-VIII in FIG. 7.

As a result of the above-described division along the x-direction division planes 32 and the y-direction division planes 33, the conductor films 30 are divided. Consequently, the conductor films 30 become the bottom surface electrode portions 19 of the first terminal electrode 17 and the second terminal electrode 18 of the individual wire-wound cores 1. FIG. 9, which is a sectional view taken along line VIII-VIII in FIG. 7, illustrates how the conductor films 30 are divided as a result of division along the y-direction division planes 33.

In addition, FIG. 9 illustrates how the first conductors 28*a* and the second conductor 28*b* respectively in the first through-holes 26*a* and the second through-hole 26*b* are divided as a result of division along the y-direction division planes 33. As a result of this division, the first conductors 28*a* and the second conductor 28*b* become the end surface electrode portions 20 of the first terminal electrode 17 and the second terminal electrode 18 of each wire-wound core 1.

The bottom surface electrode portions 19 and the end surface electrode portions 20 of the first terminal electrode 17 and the second terminal electrode 18 of each wire-wound core 1 are formed by the division described above. In such a case, when a width direction denotes a direction in which the first flange-portion lateral surface 13 and the second flange-portion lateral surface 14 face each other, each of the bottom surface electrode portions 19 is disposed all over the width direction of the flange-portion bottom surface 11 and reaches the first flange-portion lateral surface 13 and the second flange-portion lateral surface 14 as illustrated in FIG. 1. In addition, each of the end surface electrode portions 20 is disposed at a central portion excluding both end portions of the corresponding outer end surface 16 in the width direction and is located on the inner side of the first flange-portion lateral surface 13 and the second flange-portion lateral surface 14 as illustrated in FIG. 1. Note that the width direction is a direction that is perpendicular to the longitudinal direction of the core portion 4 and is parallel to the bottom surface to be oriented toward the mount board M when the wire-wound core 1 is mounted.

Note that either the division along the x-direction division planes 32 or the division along the y-axis direction division planes 33 may be performed first.

The wire-wound core 1 obtained in the above-described manner is fired. Consequently, the unfired mother sheets 25*a* to 25*c* containing a ceramic material such as alumina or ferrite are sintered, and the first terminal electrode 17 and the second terminal electrode 18 formed of the conductive paste are also sintered. Although the mother block 27 is divided usually by cutting, another method may be used in which grooves for fold-cutting are formed in advance and the mother block 27 is cut by folding along the grooves after being fired.

The wire-wound core 1 has following structural characteristics as a result of the manufacturing method described above.

First, both the outer end surface 16 of the first flange portion 5 and an outside-facing face (face that is exposed from the outer end surface 16) of the end surface electrode portion 20 of the first terminal electrode 17 are flat surfaces and are flush with each other. In addition, both the outer end surface 16 of the second flange portion 6 and an outside-facing face (face that is exposed from the outer end surface 16) of the end surface electrode portion 20 of the second terminal electrode 18 are flat surfaces and are flush with each other. This is because both the outer end surface 16 and the face of the end surface electrode portion 20 exposed from the outer end surface 16 are faces that appear as a result of division of the mother block 27 along the corresponding y-direction division plane 33 as is apparent from FIG. 9.

Note that plating such as Ni-plating or Sn-plating is applied to the first terminal electrode 17 and the second terminal electrode 18 if necessary. When such plating is applied, the faces of the end surface electrode portions 20 of the first terminal electrode 17 and the second terminal electrode 18 that are exposed from the outer end surfaces 16 protrude relative to the respective outer end surfaces 16 of the first flange portion 5 and the second flange portion 6 because of the presence of the plating film. Thus, when plating is applied, the state in which the outer end surface 16 and the outside-facing face of the end surface electrode portion 20 are flush with each other indicates that the outer end surface 16 and the face of the end surface electrode portion 20 exposed from the outer end surface 16 are flush with each other when they are compared with each other without the plating film.

In addition, the end portion of the recessed portion 21 on the flange-portion top surface 12 side is a flat surface parallel to the flange-portion top surface 12. This is because the bottom surface that defines the first through-hole 26*a* located at the end portion of the recessed portion 21 on the flange-portion top surface 12 side is provided by a flat principal surface of the first mother sheet 25*a* as is apparent from FIG. 4.

The first to third mother sheets 25*a* to 25*c* are formed of a slurry containing ceramic power such as alumina or ferrite in the first embodiment described above. Instead of this configuration, the first to third mother sheets 25*a* to 25*c* may be formed of a slurry containing glass power having a lower dielectric constant and the wire-wound core 1 formed of glass may be obtained by heating the first to third mother sheets 25*a* to 25*c*. With this configuration, a distributed capacitance of the wire-wound core 1 can be reduced, and high-frequency characteristics of the wire-wound-equipped electronic component 2 illustrated in FIG. 1 that serves as an inductor can be improved.

Second Embodiment

Figure 10:
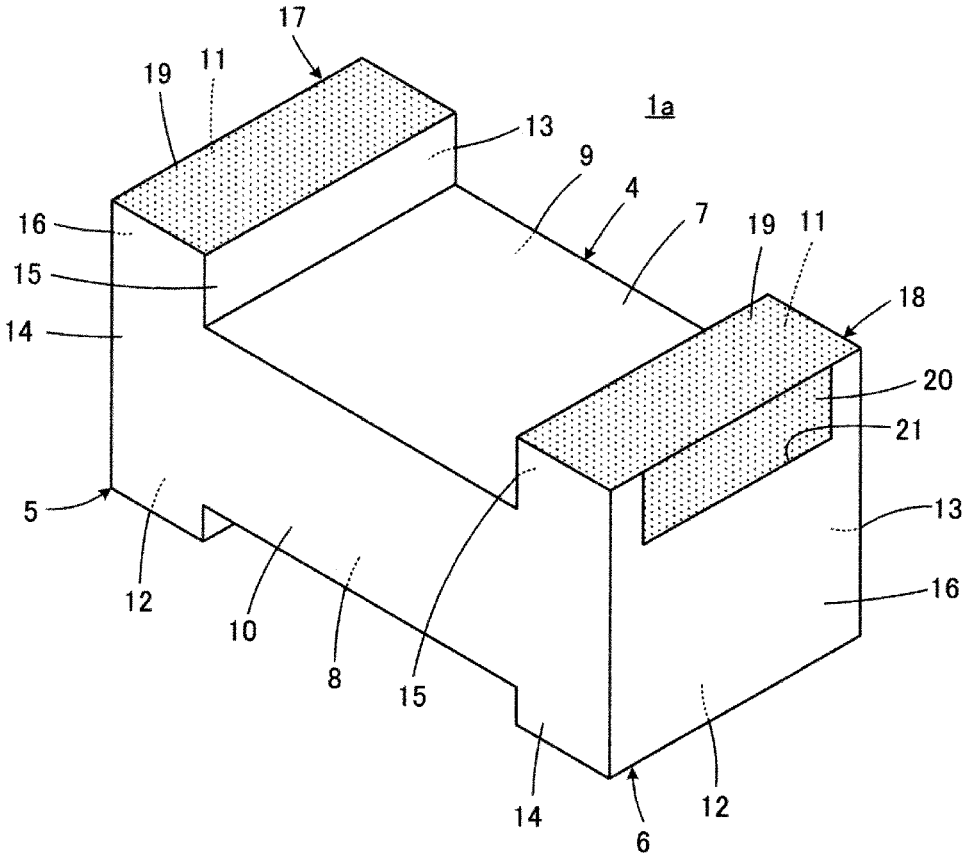
FIG. 10 is a perspective view illustrating an external appearance of a wire-wound core according to a second embodiment of this disclosure with a face to be oriented toward a mount board facing upward.

A wire-wound core 1*a* according to a second embodiment of this disclosure will be described next with reference to FIG. 10. In FIG. 10 and the subsequent figures, components equivalent to those illustrated in FIGS. 1 to 9 are denoted by the same or substantially the same reference signs to omit a duplicate description.

In the first embodiment described above, the core-portion top surface 8 of the wire-wound core 1 and the flange-portion top surfaces 12 are flush with each other. In contrast, in the second embodiment, the core-portion top surface 8 of the wire-wound core 1*a* is lower than the flange-portion top surfaces 12. That is, the core-portion top surface 8 is located closer to the mount board M than the flange-portion top surfaces 12. With such a configuration, the wound wire 3 (see FIG. 1) is successfully configured not to protrude to outside of the first flange portion 5 and the second flange portion 6 on the core-portion top surface 8 side. Thus, the wound wire 3 is successfully protected from stress applied from the core-portion top surface 8 side.

Figure 11:
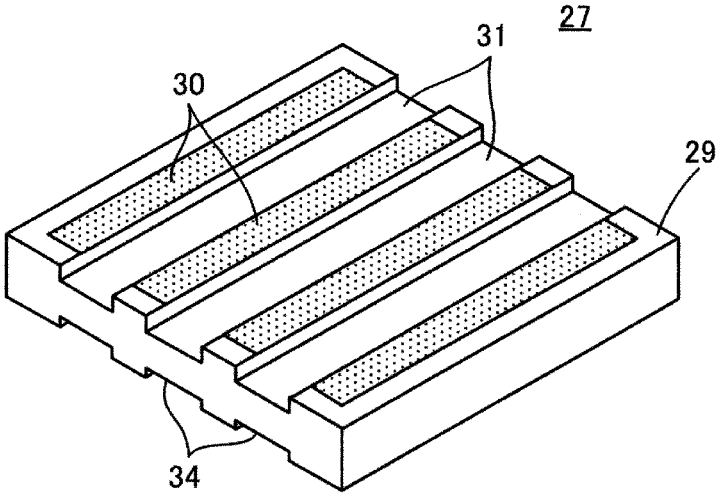
FIG. 11 describes a step of manufacturing the wire-wound core illustrated in FIG. 10 and is a perspective view illustrating a state in which second grooves as well as the first grooves are formed on the mother block illustrated in FIG. 6.

The wire-wound core 1*a* according to the second embodiment can be fabricated by modifying part of the above-described manufacturing method of the wire-wound core 1 according to the first embodiment in the following manner. Specifically, as illustrated in FIG. 11, a step of forming second grooves 34 on the mother block 27 from a top surface side opposite to the first principal surface 29 side of the third mother sheet 25*c* (see FIG. 4) is further performed to expose a face that serves as the core-portion top surface 8 in the mother block 27. Briefly, as illustrated in FIG. 11, the second grooves 34 as well as the first grooves 31 are formed on the mother block 27 illustrated in FIG. 6.

Note that either the first grooves 31 or the second grooves 34 may be formed first. In addition, the first grooves 31 and the second grooves 34 may have the same or substantially the same depth or different depths.

The core-portion top surface 8 of the resultant wire-wound core 1*a* is provided by the bottom surface of the second groove 34. Thus, the diameter of the core portion 4 is appropriately changeable by changing not only the depth of the first groove 31 but also the depth of the second groove 34. This can contribute to an improvement in the preciseness of the dimensions of the core portion 4.

Third Embodiment

Figure 12:
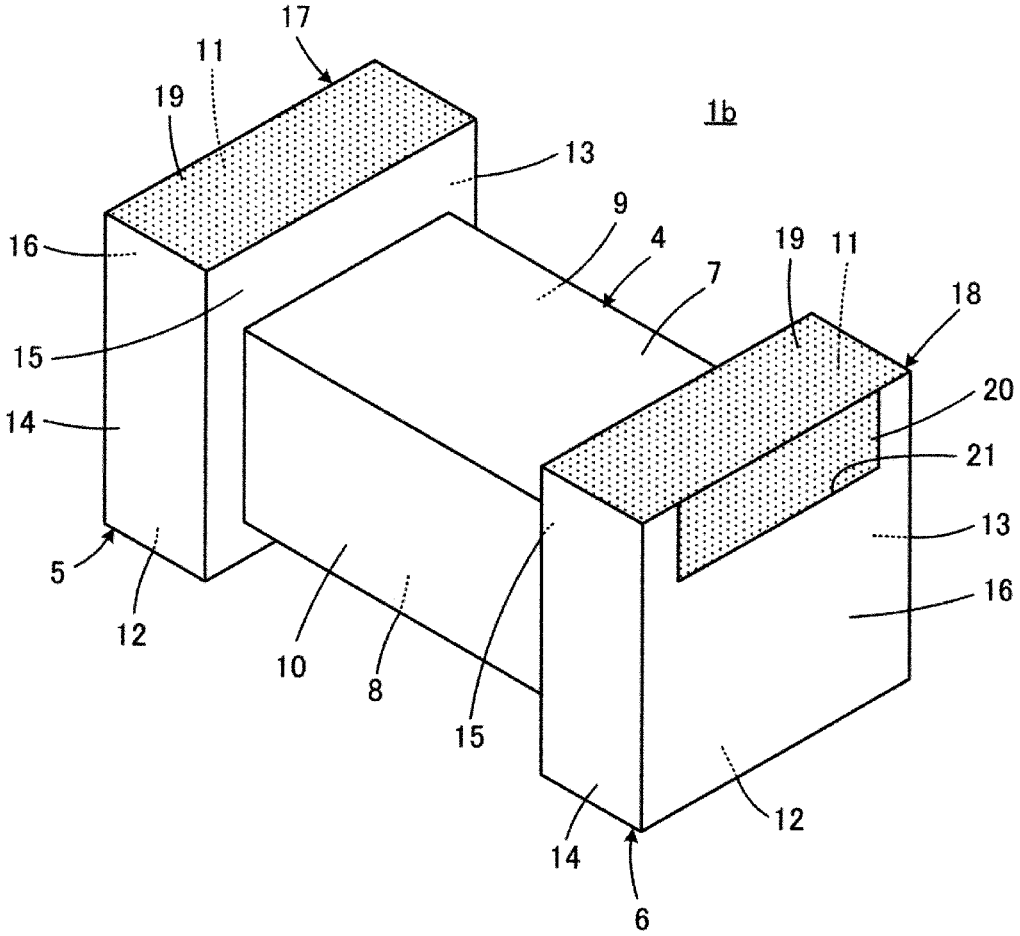
FIG. 12 is a perspective view illustrating an external appearance of a wire-wound core according to a third embodiment of this disclosure with a face to be oriented toward a mount board facing upward.

A wire-wound core 1*b* according to a third embodiment of this disclosure will be described next with reference to FIG. 12.

In the third embodiment, the core-portion top surface 8 of the wire-wound core 1*b* is lower than the flange-portion top surfaces 12 as in the second embodiment described above. With this configuration, the wound wire 3 (see FIG. 1) is successfully configured not to protrude to outside of the first flange portion 5 and the second flange portion 6 on the core-portion top surface 8 side.

In the second embodiment described above, the first core-portion lateral surface 9 of the wire-wound core 1*a* is flush with the first flange-portion lateral surfaces 13 and the second core-portion lateral surface 10 of the wire-wound core 1*a* is flush with the second flange-portion lateral surfaces 14. In contrast, in the third embodiment, the first core-portion lateral surface 9 and the second core-portion lateral surface 10 of the wire-wound core 1*b* are lower than the first flange-portion lateral surface 13 and the second flange-portion lateral surface 14, respectively. In other words, in the third embodiment, the first core-portion lateral surface 9 and the second core-portion lateral surface 10 are closer to a central axis of the core portion 4 than the first flange-portion lateral surface 13 and the second flange-portion lateral surface 14, respectively. Briefly, the first core-portion lateral surface 9 and the second core-portion lateral surface 10 are located on the inner side than the first flange-portion lateral surface 13 and the second flange-portion lateral surface 14, respectively. With such a configuration, the wound wire 3 is successfully configured not to protrude to outside of the first flange portion 5 and the second flange portion 6 also on the first core-portion lateral surface 9 side and the second core-portion lateral surface 10 side.

Thus, according to the third embodiment, the wound wire 3 is successfully protected from stress applied from the core-portion top surface 8 side and stress applied from the first core-portion lateral surface 9 side and the second core-portion lateral surface 10 side.

Figure 13:
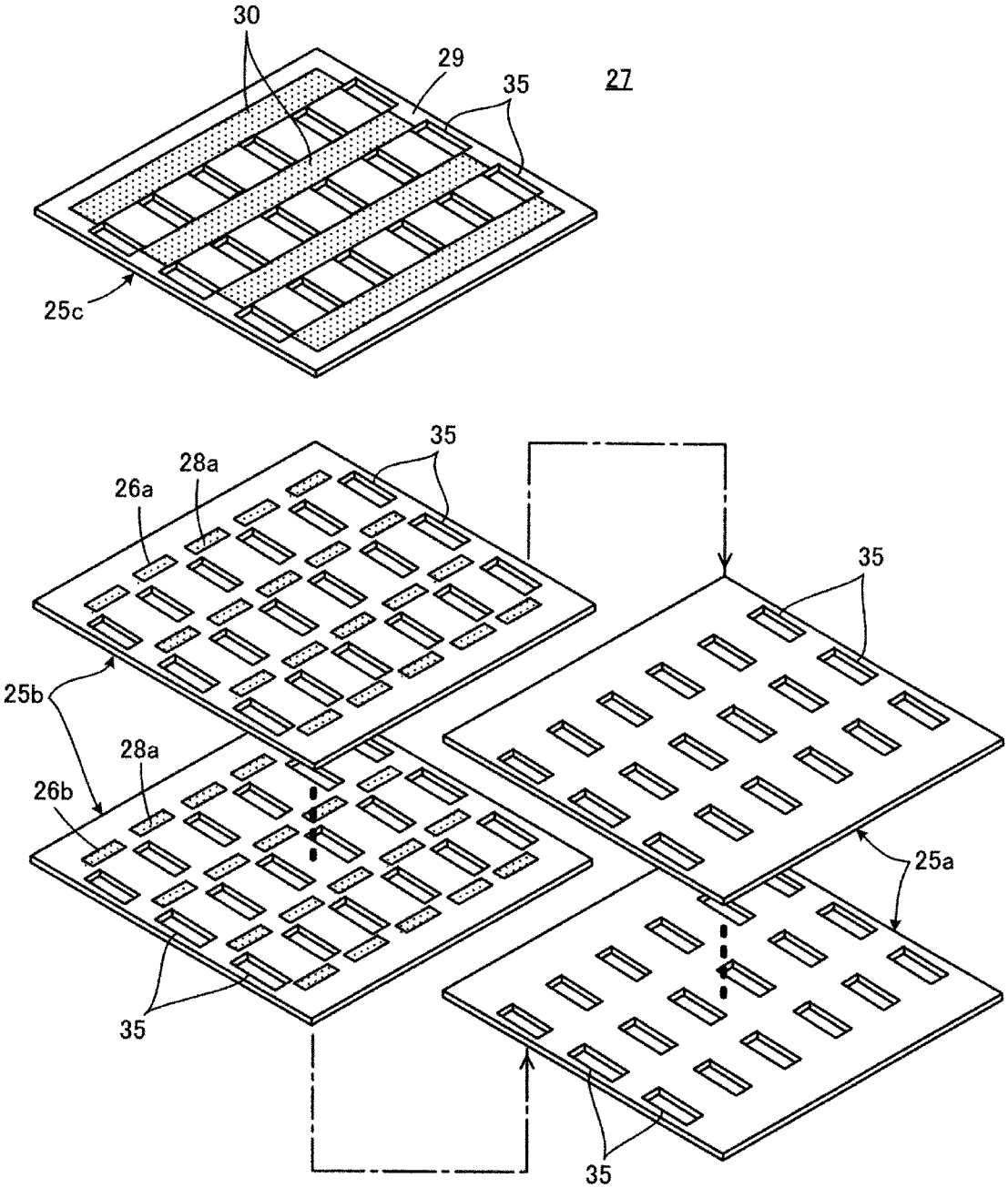
FIG. 13 describes a step of manufacturing the wire-wound core illustrated in FIG. 12 and is a diagram corresponding to FIG. 4.

To make the first core-portion lateral surface 9 and the second core-portion lateral surface 10 lower than the first flange-portion lateral surfaces 13 and the second flange-portion lateral surfaces 14, respectively, third through-holes 35 are formed in all the first to third mother sheets 25*a* to 25*c* as illustrated in FIG. 13 during fabrication of the wire-wound core 1*b* according to the third embodiment. The third through-holes 35 are located to stretch over the respective x-direction division planes 32 (see FIG. 7). The third through-holes 35 may be formed in advance in the first to third mother sheets 25*a* to 25*c* before stacking, or may be collectively formed in all the first to third mother sheets 25*a* to 25*c* of the mother block 27 obtained by stacking the first to third mother sheets 25*a* to 25*c*. The diameter of the core portion 4 is appropriately changeable by changing the shape and the dimensions of the third through-holes 35.

In addition, the step illustrated in FIG. 11 that is adopted in the second embodiment, specifically, the step of forming the second grooves 34 on the mother block 27 to expose a face that serves as the core-portion top surface 8 in the mother block 27 is also performed in the case of manufacturing the wire-wound core 1*b* according to the third embodiment.

The other steps are performed as in the first embodiment.

An embodiment in which the first core-portion lateral surface 9 and the second core-portion lateral surface 10 are lower than the first flange-portion lateral surfaces 13 and the second flange-portion lateral surfaces 14, respectively, but the core-portion top surface 8 and the flange-portion top surfaces 12 are flush with each other may be conceivable as a modification of the third embodiment.

Fourth Embodiment

A wire-wound core 1*c* according to a fourth embodiment of this disclosure will be described next with reference to FIG. 14.

In the first to third embodiments described above, a single first terminal electrode 17 is disposed at the first flange portion 5 and a single second terminal electrode 18 is disposed at the second flange portion 6. In contrast, in the fourth embodiment, two first terminal electrodes 17*a* and 17*b* are disposed at the first flange portion 5 in the width direction, and two second terminal electrodes 18*a* and 18*b* are disposed at the second flange portion 6 in the width direction.

Each of the first terminal electrodes 17*a* and 17*b* and the second terminal electrodes 18*a* and 18*b* includes the bottom surface electrode portion 19 formed of a film conductor that extends along the flange-portion bottom surface 11 and the end surface electrode portion 20 that is continuous to the bottom surface electrode portion 19 and is formed of a conductor filling the recessed portion 21 that is formed to reach the flange-portion bottom surface 11 on the outer end surface 16. Note that the end surface electrode portion 20 that is continuous to the bottom surface electrode portion 19 may be integrated with the bottom surface electrode portion 19 or may be just in contact with the bottom surface electrode portion 19.

The wire-wound core 1*c* according to the fourth embodiment is advantageously used in a wire-wound-equipped electronic component such as a coil component including two wound wires and four terminal electrodes, for example, a common-mode choke coil or a transformer. For example, in the case of a common-mode choke coil, two wires are wound around the core portion 4 in the same direction. A first end of a first wound wire, among the two wires, is connected to the first terminal electrode 17*a*, and a second end of the first wound wire is connected to the second terminal electrode 18*a*. In addition, a first end of a second wound wire, among the two wires, is connected to the first terminal electrode 17*b*, and a second end of the second wound wire is connected to the second terminal electrode 18*b*.

The wire-wound core 1*c* according to the fourth embodiment can be fabricated by changing part of the manufacturing method of the wire-wound core 1 according to the first embodiment described above in the following manner.

Figure 15:
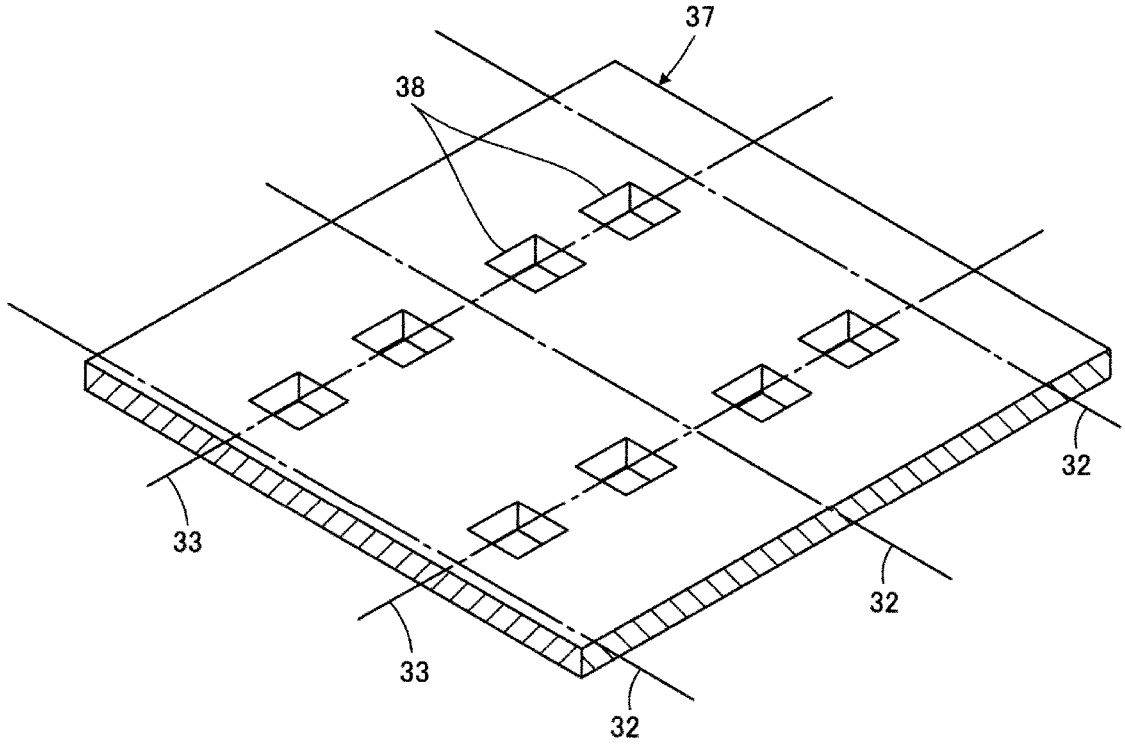
FIG. 15 is a perspective view illustrating a state in which through-holes are formed in an unprocessed mother sheet prepared for fabrication of the wire-wound core illustrated in FIG. 14.

Specifically, a mother sheet 37 illustrated in FIG. 15 is used in place of the mother sheet 25 having the through-holes 26 illustrated in FIG. 3. FIG. 15 illustrates a portion of the mother sheet 37 in an enlarged manner. A plurality of through-holes 38 are formed in the mother sheet 37. In FIG. 15, the x-direction division planes 32 and the y-direction division planes 33 are denoted by alternate long and short dashed lines. Two through-holes 38 are disposed in each region between the two adjacent x-direction division planes 32 along the corresponding y-direction division plane 33 to stretch over the corresponding y-direction division plane 33. Each of the through-holes 38 provides the recessed portion 21 in which a conductor that serves as the end surface electrode portion 20 of a corresponding one of the first terminal electrodes 17*a* and 17*b* and the second terminal electrodes 18*a* and 18*b* is disposed.

Figure 16:
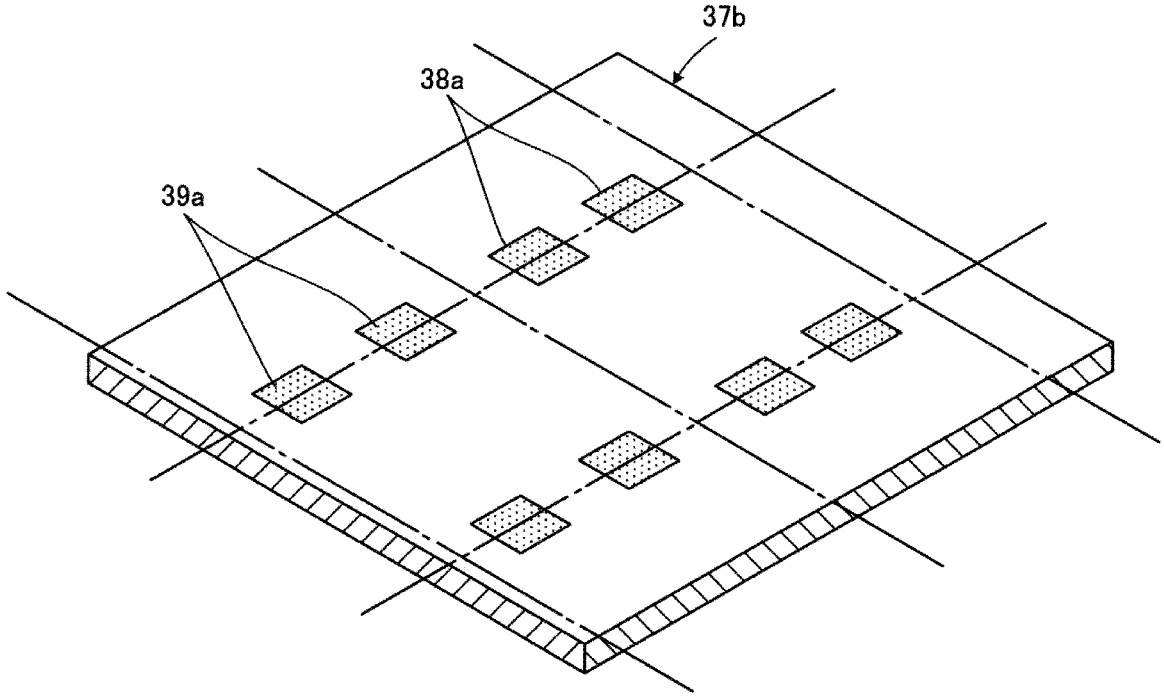
FIG. 16 is a perspective view illustrating a second mother sheet in which first conductors are disposed in respective first through-holes corresponding to the through-holes illustrated in FIG. 15.
Figure 17:
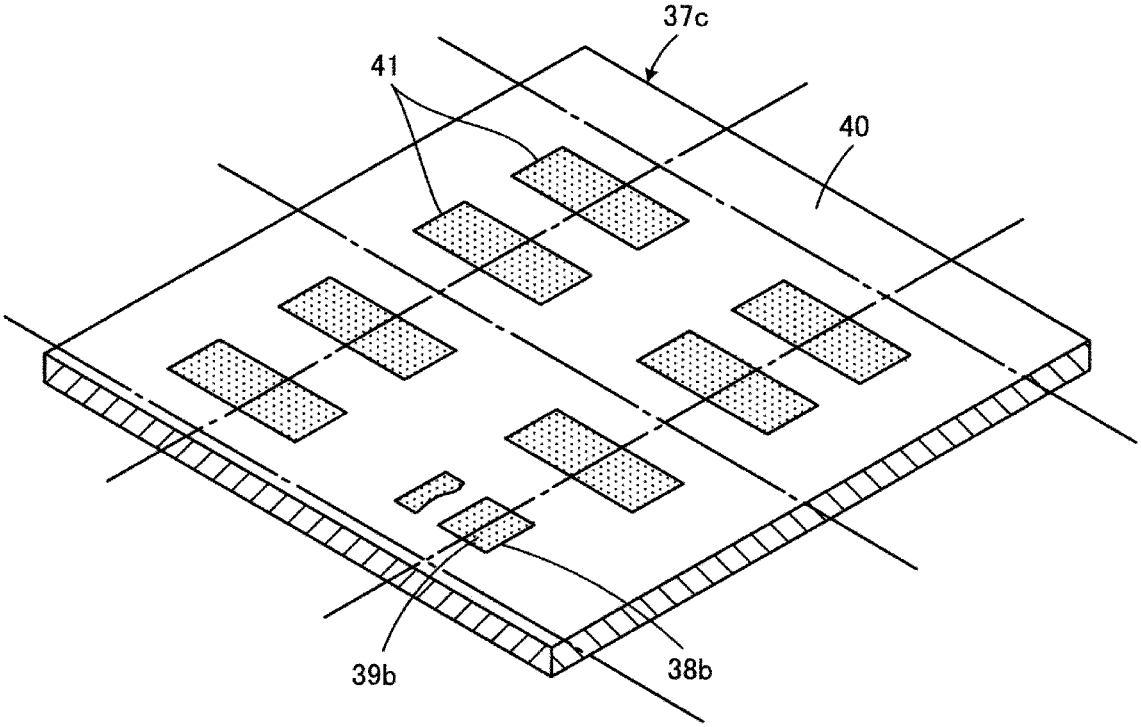
FIG. 17 is a perspective view illustrating a third mother sheet corresponding to the second mother sheet illustrated in FIG. 16 on which conductor films are disposed.

In the fourth embodiment, second mother sheets 37*b* illustrated in FIG. 16 and a third mother sheet 37*c* illustrated in FIG. 17 are respectively used in place of the second mother sheets 25*b* and the third mother sheet 25*c* illustrated in FIG. 4 in the first embodiment when the mother sheets 37 are stacked. Each of the second mother sheet 37*b* illustrated in FIG. 16 and the third mother sheet 37*c* illustrated in FIG. 17 is created using the mother sheet 37 illustrated in FIG. 15.

In the second mother sheet 37*b* illustrated in FIG. 16, the through-holes 38 of the mother sheet 37 illustrated in FIG. 15 are used as first through-holes 38*a* and first conductors 39*a* are disposed in the respective first through-holes 38*a*. For example, the first conductors 39*a* are formed of a conductive paste with which the first through-holes 38*a* are filled by printing.

The third mother sheet 37*c* illustrated in FIG. 17 has a plurality of conductor films 41 on a first principal surface 40 thereof. In the third mother sheet 37*c* illustrated in FIG. 17, the through-holes 38 of the mother sheet 37 illustrated in FIG. 15 are used as second through-holes 38*b* and second conductors 39*b* are disposed in the respective second through-holes 38*b* as illustrated by removing a portion of the conductor film 41 located on the right-lowermost side in FIG. 17. Each of the conductor films 41 is disposed at a position to cover the corresponding second conductor 39*b* disposed in the corresponding second through-hole 38*b*.

For example, the second conductors 39*b* are formed of a conductive paste with which the second through-holes 38*b* are filled by printing, just like the first conductors 39*a*. In addition, the conductor films 41 are formed by printing a conductive paste, for example. Note that filling of the second through-holes 38*b* with the conductive paste serving as the second conductors 39*b* is preferably performed simultaneously with printing of the conductive paste forming the conductor films 41.

A mother block is obtained by using the second mother sheets 37*b* and the third mother sheet 37*c* described above in place of the second mother sheets 25*b* and the third mother sheet 25*c* illustrated in FIG. 4, respectively, and by stacking the first mother sheets 25*a*, the second mother sheets 37*b*, and the third mother sheet 37*c* together. Then, substantially the same steps as those of the first embodiment are performed. Consequently, the wire-wound core 1*c* illustrated in FIG. 14 is obtained.

In the wire-wound core 1*c*, the bottom surface electrode portions 19 of the first terminal electrodes 17*a* and 17*b* and the second terminal electrodes 18*a* and 18*b* are provided by division of the conductor films 41 described above. In addition, the end surface electrode portions 20 are provided by the first conductors 39*a* and the second conductors 39*b* filling the recessed portions 21, which are obtained by cutting the first through-holes 38*a* and the second through-holes 38*b*.

If a plurality of terminal electrodes disposed at a single flange portion are formed only by applying a conductive paste, a complex application process is needed because the terminal electrodes have a fine structure and a space between the terminal electrodes is narrow. However, when the method described above is used, a plurality of terminal electrodes can be easily formed even if the plurality of terminal electrodes have a fine structure and are arranged with a narrow space therebetween.

Fifth Embodiment

Figure 18:
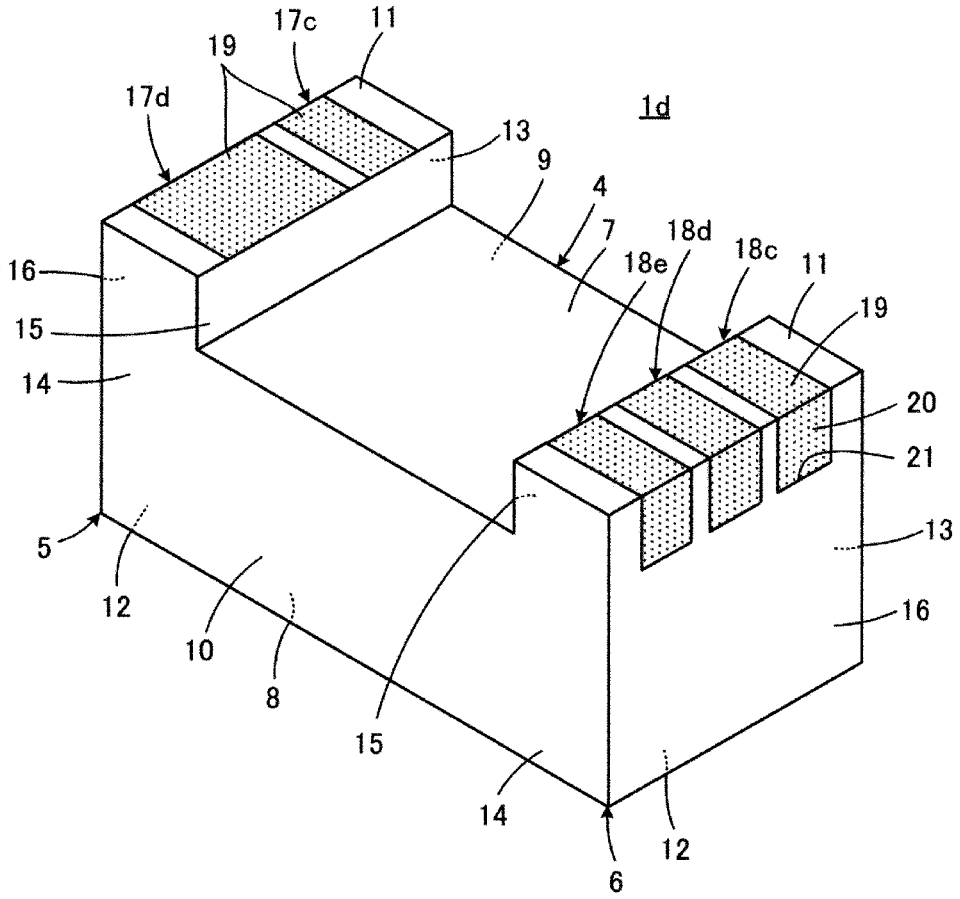
FIG. 18 is a perspective view illustrating an external appearance of a wire-wound core according to a fifth embodiment of this disclosure with a face to be oriented toward a mount board facing upward.

A wire-wound core 1*d* according to a fifth embodiment of this disclosure will be described next with reference to FIG. 18.

In the first to fourth embodiments described above, when a perpendicular bisector plane of the central axis extending in the longitudinal direction of the core portion 4 serves as a symmetry plane, the first terminal electrode 17 or the first terminal electrodes 17*a* and 17*b* disposed at the first flange portion 5 and the second terminal electrode 18 or the second terminal electrodes 18*a* and 18*b* disposed at the second flange portion 6 are symmetrical about the symmetry plane. In contrast, in the fifth embodiment, first terminal electrodes 17*c* and 17*d* disposed at the first flange portion 5 and second terminal electrodes 18*c*, 18*d*, and 18*e* disposed at the second flange portion 6 are asymmetrical about the symmetry plane.

More specifically, in the fifth embodiment, the two first terminal electrodes 17*c* and 17*d* are disposed at the first flange portion 5 in the width direction, and the three second terminal electrodes 18*c*, 18*d*, and 18*e* are disposed at the second flange portion 6 in the width direction. In addition, the first terminal electrode 17*d* disposed at the first flange portion 5 has a width-direction dimension larger than the first terminal electrode 17*c*.

Since the wide terminal electrode 17*d* of the wire-wound core 1*d* according to the fifth embodiment successfully provides a sufficient area for connecting ends of two or more wires thereto, the wire-wound core 1*d* can advantageously constitute a coil component such as a pulse transformer including a center tap, for example.

The wire-wound core 1*d* according to the fifth embodiment can be fabricated by modifying part of the manufacturing method of the wire-wound core 1*c* according to the fourth embodiment described above in the following manner.

Figure 19:
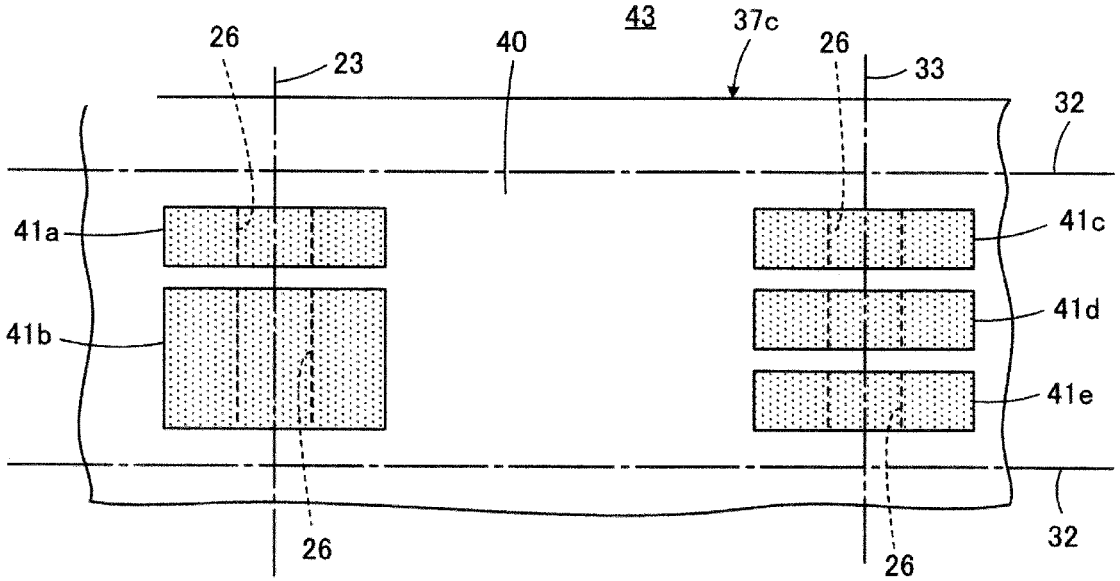
FIG. 19 is a plan view illustrating a portion of a mother block created to fabricate the wire-wound core illustrated in FIG. 18.

FIG. 19 is a plan view illustrating a portion of a mother block 43 created to fabricate the wire-wound core 1*d* according to the fifth embodiment. In FIG. 19, the x-direction division planes 32 and the y-direction division planes 33 are denoted by alternate long and short dash lines. On the first principal surface 40 of the third mother sheet 37*c* located on one end of the mother block 43 in the stacking direction, conductor films 41*a* and 41*b* that serve as the bottom surface electrode portions 19 of the first terminal electrodes 17*c* and 17*d* disposed at the first flange portion 5 and conductor films 41*c*, 41*d*, and 41*e* that serve as the bottom surface electrode portions 19 of the second terminal electrodes 18*c*, 18*d*, and 18*e* disposed at the second flange portion 6 are disposed along the respective y-direction division planes 33 to stretch over the respective y-direction division planes 33. In FIG. 19, the through-holes 26 for the recessed portions 21 that define the end surface electrode portions 20 of the first terminal electrodes 17*c* and 17*d* and the through-hole 26 for the recessed portions 21 that define the end surface electrode portions 20 of the second terminal electrodes 18*c*, 18*d*, and 18*e* disposed at the second flange portion 6 are denoted by dash lines.

As is apparent from FIG. 19, the number, the positions, dimensions, and/or shapes of conductor films for the bottom surface electrodes portions of the terminal electrodes can be modified variously from the configuration of the terminal electrodes by changing the number, positions, dimensions, and/or shapes of through-holes for the recessed portions that define the end surface electrode portions.

Sixth Embodiment

Figure 20:
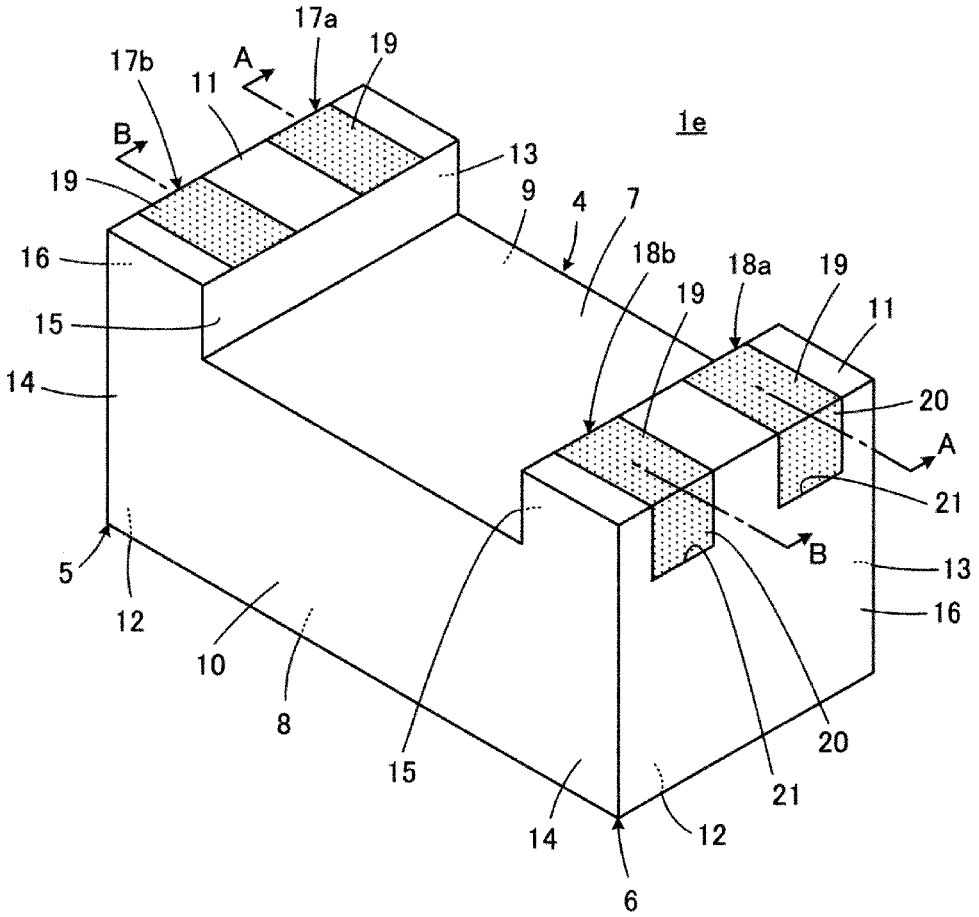
FIG. 20 is a perspective view illustrating an external appearance of a wire-wound core according to a sixth embodiment of this disclosure with a face to be oriented toward a mount board facing upward.

A wire-wound core 1*e* according to a sixth embodiment of this disclosure will be described next with reference to FIG. 20.

Figure 14:
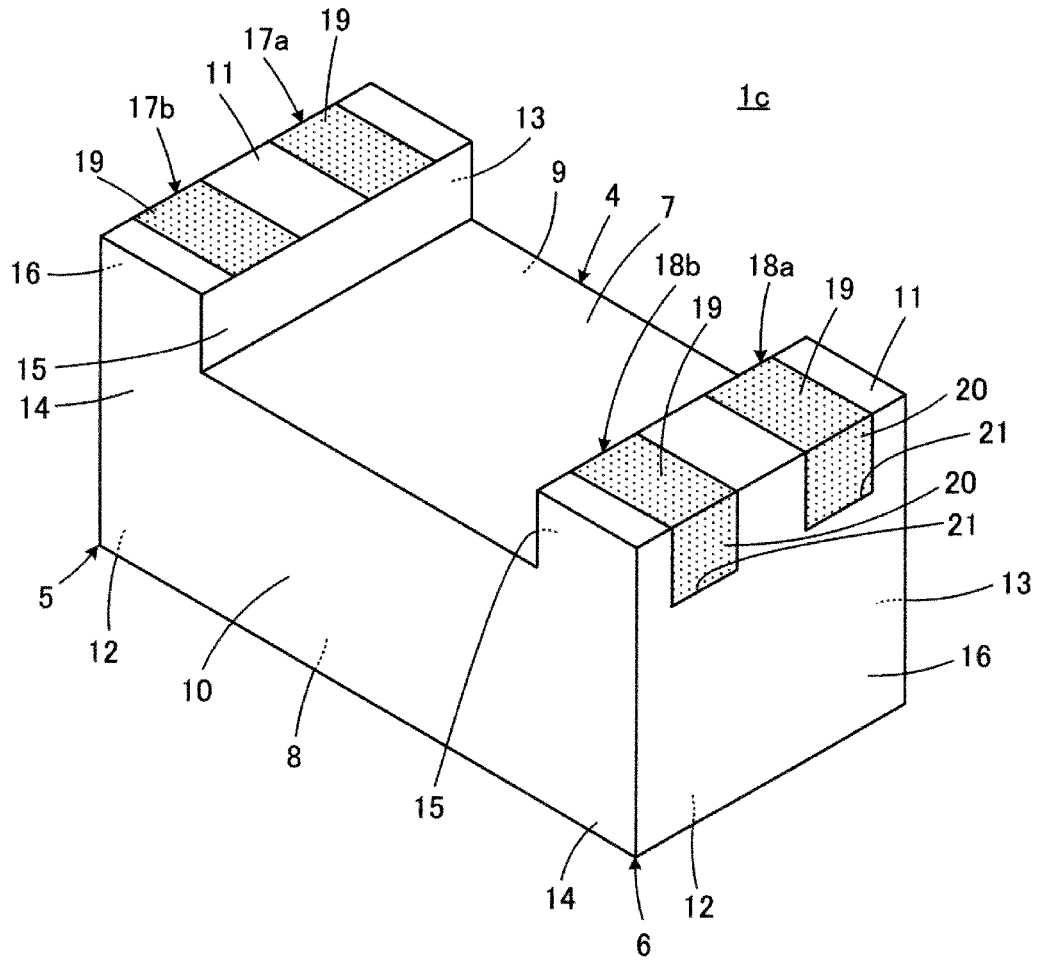
FIG. 14 is a perspective view illustrating an external appearance of a wire-wound core according to a fourth embodiment of this disclosure with a face to be oriented toward a mount board facing upward.

The wire-wound core 1*e* according to the sixth embodiment has substantially the same external appearance as the wire-wound core 1*c* according to the fourth embodiment illustrated in FIG. 14. Thus, the same or substantially the same reference signs as those denoting the components illustrated in FIG. 14 are used in FIG. 20.

Figure 21A:
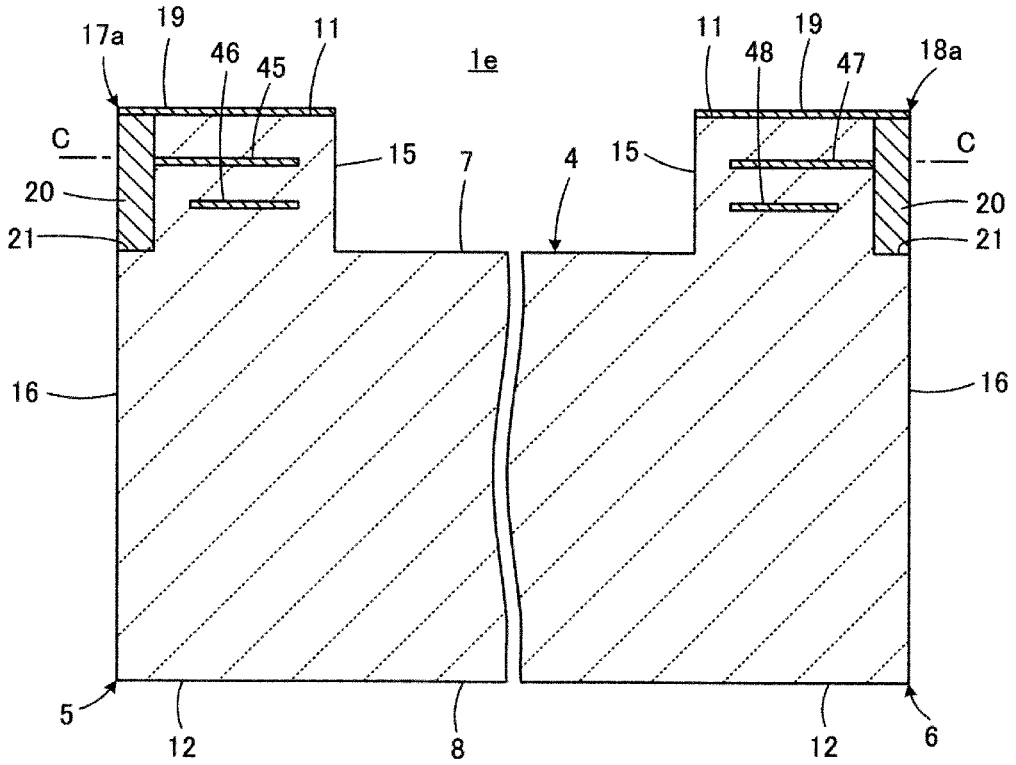
FIGS. 21A and 21B are partially enlarged views of the wire-wound core illustrated in FIG. 20, specifically.
Figure 21B:
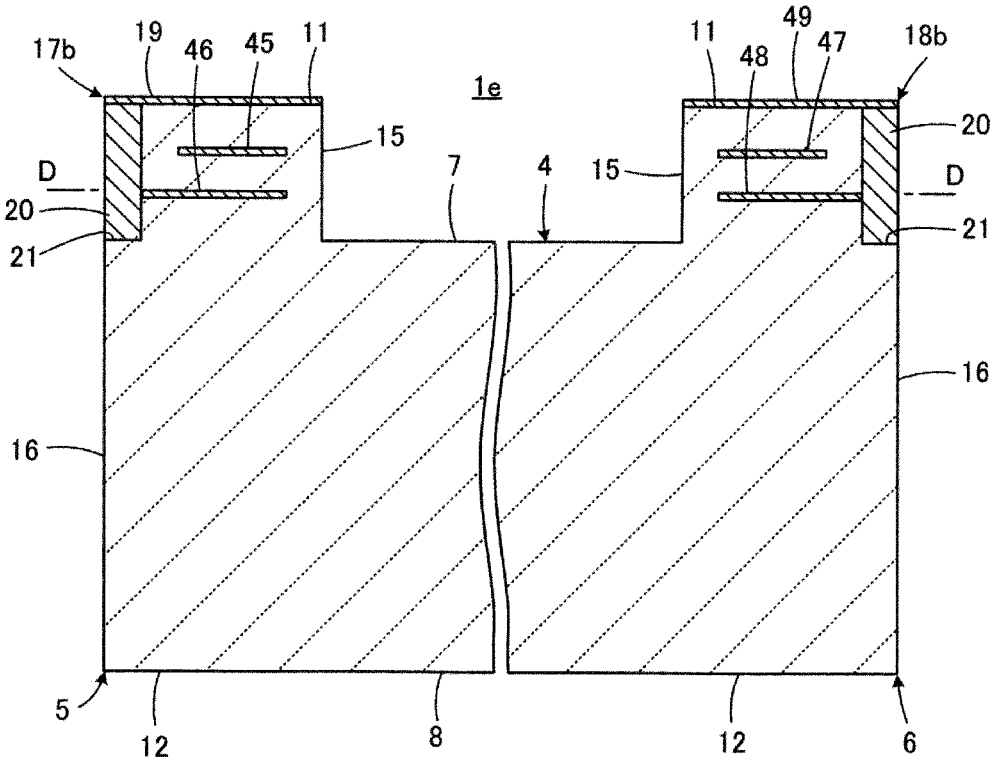

The wire-wound core 1*e* according to the sixth embodiment includes passive elements at the first flange portion 5 and the second flange portion 6. FIGS. 21A and 21B are partially enlarged views of the wire-wound core 1*e*. Specifically, FIG. 21A is a sectional view taken along line A-A in FIG. 20, and FIG. 21B is a sectional view taken along line B-B in FIG. 20.

In the sixth embodiment, the wire-wound core 1*e* includes capacitors as the passive elements. As illustrated in FIGS. 21A and 21B, first capacitor electrodes 45 and 46 opposing each other are disposed at the first flange portion 5, and second capacitor electrodes 47 and 48 opposing each other are disposed at the second flange portion 6.

The end surface electrode portions 20 of the first terminal electrodes 17*a* and 17*b* and the second terminal electrodes 18*a* and 18*b* also contribute to electrical connections of the first and second capacitor electrodes 45 to 48. More specifically, the first capacitor electrodes 45 and 46 are electrically connected to the first terminal electrodes 17*a* and 17*b*, respectively. The second capacitor electrodes 47 and 48 are electrically connected to the second terminal electrodes 18*a* and 18*b*, respectively. Thus, electrostatic capacity due to the first capacitor electrodes 45 and 46 opposing each other is formed between the first terminal electrodes 17*a* and 17*b*. Likewise, electrostatic capacity due to the second capacitor electrodes 47 and 48 opposing each other is formed between the second terminal electrodes 18*a* and 18*b*.

Figure 22A:
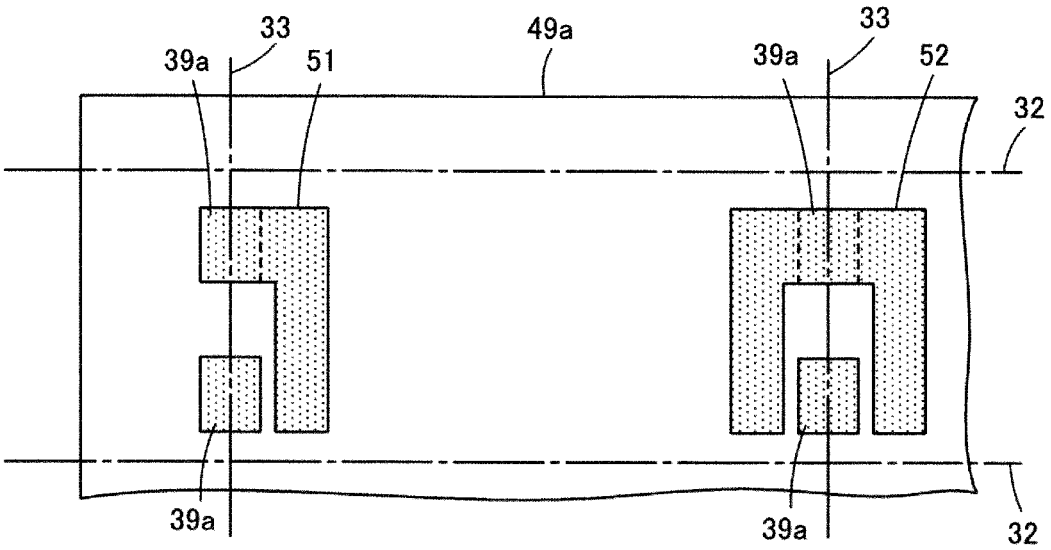
FIGS. 22A and 22B are plan views illustrating portions of two types of the second mother sheets prepared for fabrication of the wire-wound core illustrated in FIG. 20, specifically.
Figure 22B:
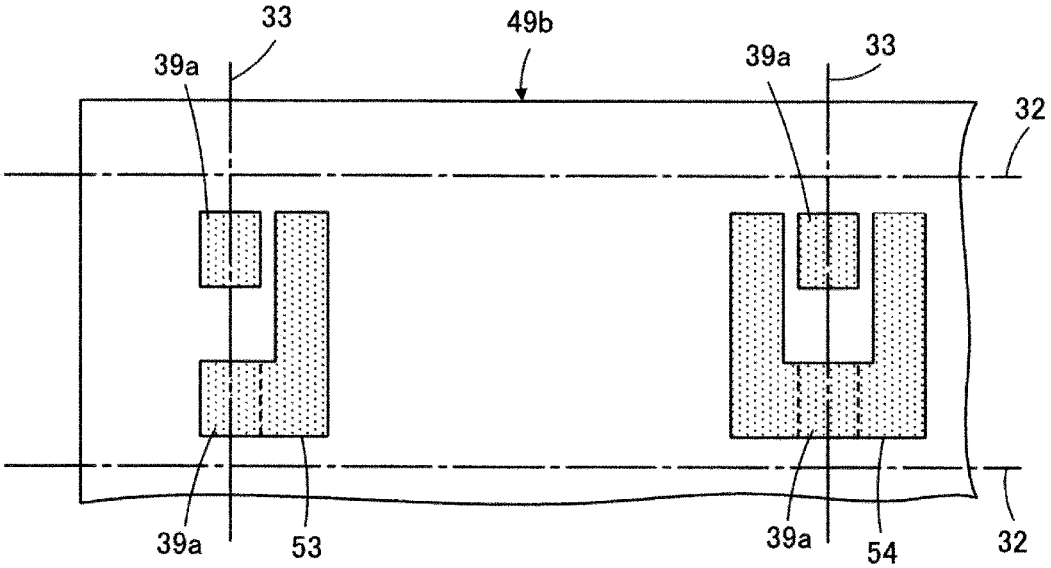

FIGS. 22A and 22B are plan views of portions of two kinds of second mother sheets 49*a* and 49*b* prepared for fabrication of the wire-wound core 1*e*. Specifically, FIG. 22A illustrates the second mother sheet 49*a* that provides a section taken along line C-C in FIG. 21A, and FIG. 22B illustrates the second mother sheet 49*b* that provides a section taken along line D-D in FIG. 21B.

In FIGS. 22A and 22B, the x-direction division planes 32 and the y-direction division planes 33 are denoted by alternate long and short dashed lines. The portion illustrated in FIGS. 22A and 22B will be described. Pattern conductors 51 and 52 that respectively serve as the first capacitor electrode 45 and the second capacitor electrode 47 when the second mother sheet 49*a* is divided at the y-direction division planes 33 are disposed on the second mother sheet 49*a* illustrated in FIG. 22A. Pattern conductors 53 and 54 that respectively serve as the first capacitor electrode 46 and the second capacitor electrode 48 when the second mother sheet 49*b* is divided at the y-direction division planes 33 are disposed on the second mother sheet 49*b* illustrated in FIG. 22B.

As illustrated in FIG. 22A, the pattern conductor 51 is connected to the conductor 39*a* that provides the end surface electrode portion 20 of the first terminal electrode 17*a*, and the pattern conductor 52 is connected to the conductor 39*a* that provides the end surface electrode portions 20 of the first terminal electrode 17*a* and the second terminal electrode 18*a*. As illustrated in FIG. 22B, the pattern conductor 53 is connected to the conductor 39*a* that provides the end surface electrode portion 20 of the first terminal electrode 17*b*, and the pattern conductor 54 is connected to the conductor 39*a* that provides the end surface electrode portions 20 of the first terminal electrode 17*b* and the second terminal electrode 18*b*.

Thus, the wire-wound core 1*e* according to the sixth embodiment can be obtained by replacing at least some of the second mother sheets 37*b* with the second mother sheets 49*a* and 49*b* in the manufacturing method of the wire-wound core 1*c* according to the fourth embodiment described above.

Figure 23:
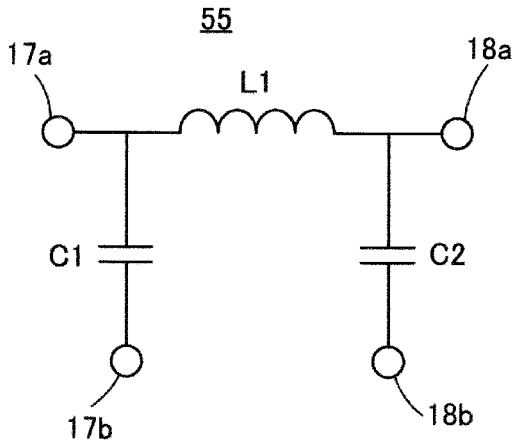
FIG. 23 is an equivalent circuit diagram of a $\pi$ filter that can be implemented using the wire-wound core illustrated in FIG. 20.

The wire-wound core 1*e* according to the sixth embodiment can constitute a filter having a good noise removal effect, such as a π filter 55 whose equivalent circuit is illustrated in FIG. 23.

To obtain the π filter 55 illustrated in FIG. 23, the wound wire disposed at the core portion 4 of the wire-wound core 1*e* implements an inductor L1, a first end of the wound wire is connected to the first terminal electrode 17*a*, and a second end of the wound wire is connected to the second terminal electrode 18*a*. Consequently, the π filter 55 is obtained in which the inductor L1 is connected between the first terminal electrode 17*a* and the second terminal electrode 18*a*, a capacitor C1 is connected between the first terminal electrodes 17*a* and 17*b*, and a capacitor C2 is connected between the second terminal electrodes 18*a* and 18*b* as illustrated in FIG. 23.

Figure 24:
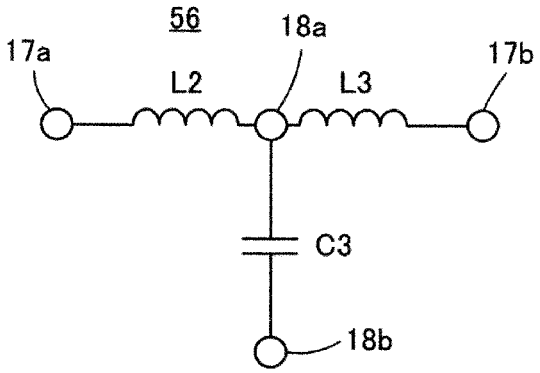
FIG. 24 is an equivalent circuit diagram of a T filter that can be implemented using a modification of the wire-wound core illustrated in FIG. 20.
Figure 25:
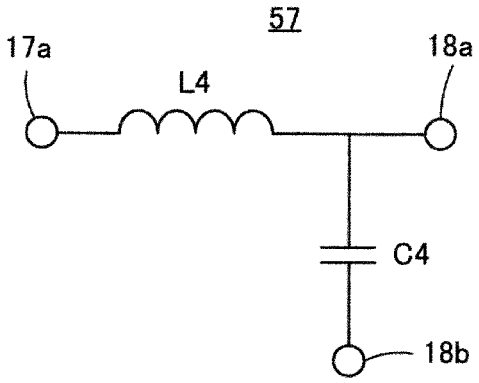
FIG. 25 is an equivalent circuit diagram of an L filter that can be implemented using another modification of the wire-wound core illustrated in FIG. 20.

In addition, if the wire-wound core 1*e* according to the sixth embodiment is slightly modified, filters such as a T filter 56 and an L filter 57 whose equivalent circuits are respectively illustrated in FIGS. 24 and 25 can be obtained.

To obtain the T filter 56 illustrated in FIG. 24, one set of capacitor electrodes, for example, the first capacitor electrodes 45 and 46 of the wire-wound core 1*e* is omitted. Two wound wires are disposed at the core portion 4. A first end of a first wound wire, among the two wound wires, is connected to the first terminal electrode 17*a*, and a second end of the first wound wire is connected to the second terminal electrode 18*a*. A first end of a second wound wire, among the two wound wires, is connected to the first terminal electrode 17*b*, and a second end of the second wound wire is connected to the second terminal electrode 18*a*. Consequently, the T filter 56 is obtained in which an inductor L2 is connected between the first terminal electrode 17*a* and the second terminal electrode 18*a*, an inductor L3 is connected between the first terminal electrode 17*b* and the second terminal electrode 18*a*, and a capacitor C3 is connected between the second terminal electrodes 18*a* and 18*b*.

To obtain the L filter 57 illustrated in FIG. 25, one set of capacitor electrodes, for example, the first capacitor electrodes 45 and 46 of the wire-wound core 1*e* is omitted. In addition, for example, the first terminal electrode 17*b* may be omitted. The wound wire disposed at the core portion 4 implements an inductor L4, a first end of the wound wire is connected to the first terminal electrode 17*a*, and a second end of the wound wire is connected to the second terminal electrode 18*a*. Consequently, the L filter 57 is obtained in which the inductor L4 is connected between the first terminal electrode 17*a* and the second terminal electrode 18*a* and a capacitor C4 is connected between the second terminal electrodes 18*a* and 18*b*.

In the wire-wound core 1*e* described above, the passive elements included in the wire-wound core 1*e* and connected between the two first terminal electrodes 17*a* and 17*b* disposed at the first flange portion 5 and between the two second terminal electrodes 18*a* and 18*b* disposed at the second flange portion 6 are capacitors. However, the passive elements may be elements having another function, for example, resistance elements.

OTHER EMBODIMENTS

While this disclosure has been described above in relation to the illustrated embodiments, various other embodiments are possible within the scope of this disclosure.

For example, as for the staking order of the mother sheets, instead of stacking the first mother sheets 25*a*, the second mother sheets 25*b*, and the third mother sheet 25*c* in this order from the bottom as illustrated in FIG. 4, the opposite stacking order may be adopted.

In addition, instead of using the method for staking a plurality of mother sheets formed in a sheet shape in advance as described above, a method for repeatedly performing printing to obtain a stacked state of a plurality of mother sheets may be used to create the mother block 27. Specifically, a method may be used which includes forming first mother sheets by printing; forming, by printing, a stack of a predetermined number of second mother sheets in which the plurality of first through-holes are formed and the first conductors are disposed in the respective first through-holes; and forming, by printing, a third mother sheet in which the plurality of second through-holes are formed and the second conductors are disposed in the respective second through-holes and that have the first principal surface on which the conductor films are formed. In the method, the forming the first mother sheets, the forming the second mother sheets, and the forming the third mother sheet are performed on any of mother sheets already formed.

In addition, when the wire-wound core includes a plurality of terminal electrodes, not all the terminal electrodes need to have the characteristic configuration of this disclosure. In other words, there may be a terminal electrode not having the characteristic configuration of this disclosure. Thus, for example, only the terminal electrode disposed at one of the flange portions may have the characteristic configuration of this disclosure.

In addition, the film conductors that constitute the bottom surface electrode portions of the terminal electrodes are formed using a conductive paste in the embodiments described above. However, the conductors may be formed using another material, for example, a plating film or a metal leaf.

In addition, the conductors serving as the end surface electrode portions of the terminal electrodes are formed using a conductive paste in the embodiments described above. However, the conductors may be formed using another material, for example, a conductive metal piece filling the recessed portion.

While some of different embodiments have been described above, the configurations of the different embodiments may be partially replaced or combined to carry out this disclosure.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A wire-wound core comprising:

a core portion having a longitudinal direction;

a first flange portion disposed at a first end portion of the core portion in the longitudinal direction;

a second flange portion disposed at a second end portion of the core portion in the longitudinal direction;

at least one terminal electrode disposed at the first flange portion; and at least one terminal electrode disposed at the second flange portion, wherein when the wire-wound core is mounted on a mount board, and a face of the first flange portion to be oriented toward the mount board is defined as a bottom surface and a face of the first flange portion that faces an outer side opposite to a side where the core portion is located is defined as an outer end surface, the outer end surface has a recessed portion that reaches the bottom surface of the first flange portion, and the terminal electrode disposed at the first flange portion includes a bottom surface electrode portion that includes a film conductor extending along the bottom surface of the first flange portion and, an end surface electrode portion that includes a conductor filling the recessed portion and is in contact with the bottom surface electrode portion, such that the recessed portion is completely filled with the end surface electrode portion.

2. The wire-wound core according to claim 1, wherein when a face opposite to the bottom surface is defined as a top surface, the top surface of the core portion and the top surface of the first flange portion are flush with each other.

3. The wire-wound core according to claim 1, wherein when a face opposite to the bottom surface is defined as a top surface, the top surface of the core portion is lower than the top surface of the first flange portion.

4. The wire-wound core according to claim 1, wherein when a face opposite to the bottom surface is defined as a top surface and a face linking the bottom surface and the top surface to each other is defined as a lateral surface, the lateral surface of the core portion and the lateral surface of the first flange portion are flush with each other.

5. The wire-wound core according to claim 1, wherein when a face opposite to the bottom surface is defined as a top surface and a face linking the bottom surface and the top surface to each other is defined as a lateral surface, the lateral surface of the core portion is lower than the lateral surface of the first flange portion.

6. The wire-wound core according to claim 1, wherein the outer end surface and an end surface of the end surface electrode portion that faces the outer side are flush with each other.

7. The wire-wound core according to claim 1, wherein when a face opposite to the bottom surface is defined as a top surface, an end portion of the recessed portion on a top surface side is a flat surface parallel to the top surface of the first flange portion.

8. The wire-wound core according to claim 1, wherein when a face opposite to the bottom surface is defined as a top surface and a face linking the bottom surface and the top surface to each other is defined as a lateral surface, the bottom surface electrode portion reaches the lateral surface of the first flange portion and the end surface electrode portion is located on an inner side than the lateral surface of the first flange portion.

9. The wire-wound core according to claim 1, wherein when a perpendicular bisector plane of a central axis extending in the longitudinal direction of the core portion is defined as a symmetry plane, the terminal electrode disposed at the first flange portion and the terminal electrode disposed at the second flange portion are symmetrical about the symmetry plane.

10. The wire-wound core according to claim 1, wherein when a perpendicular bisector plane of a central axis extending in the longitudinal direction of the core portion is defined as a symmetry plane, the terminal electrode disposed at the first flange portion and the terminal electrode disposed at the second flange portion are asymmetrical about the symmetry plane.

11. A wire-wound-equipped electronic component comprising:

the wire-wound core according to claim 1; and a wire that is wound around the core portion of the wire-wound core, the wire having ends electrically connected to the respective terminal electrodes.

12. The wire-wound core according to claim 1, wherein:

the at least one terminal electrode disposed at the first flange portion includes a plurality of terminal electrodes each being disposed at the first flange portion, the plurality of terminal electrodes being arranged in a direction that is perpendicular to the longitudinal direction and is parallel to the bottom surface.

13. The wire-wound core according to claim 12, further comprising:

a passive element that is connected to the plurality of terminal electrodes and is included in the first flange portion.

14. A wire-wound core manufacturing method for manufacturing the wire-wound core, the wire-wound core comprising:

a core portion having a longitudinal direction;

a first flange portion disposed at a first end portion of the core portion in the longitudinal direction;

a second flange portion disposed at a second end portion of the core portion in the longitudinal direction;

at least one terminal electrode disposed at the first flange portion; and at least one terminal electrode disposed at the second flange portion, wherein when the wire-wound core is mounted on a mount board, and a face of the first flange portion to be oriented toward the mount board is defined as a bottom surface and a face of the first flange portion that faces an outer side opposite to a side where the core portion is located is defined as an outer end surface, the outer end surface has a recessed portion that reaches the bottom surface of the first flange portion, and the terminal electrode disposed at the first flange portion includes a bottom surface electrode portion that includes a film conductor extending along the bottom surface of the first flange portion and, an end surface electrode portion that includes a conductor filling the recessed portion and is in contact with the bottom surface electrode portion, such that the recessed portion is completely filled with the end surface electrode portion, and the method comprising:

creating a mother block in which a plurality of first mother sheets and a plurality of second mother sheets are stacked in this order, the plurality of first mother sheets being formed of a non-conductive material, and the plurality of second mother sheets being formed of a non-conductive material and having a plurality of through-holes each of which are to be the recessed portion;

forming a first groove on the mother block from a second mother sheet side to form a face defining the bottom surface of the core portion in the mother block; and dividing the mother block along a plurality of x-direction division planes perpendicular to the bottom surface and a plurality of y-direction division planes perpendicular to the bottom surface such that each of the plurality of through-holes are to be located on a corresponding outer end surface side.

15. The wire-wound core manufacturing method according to claim 14, wherein in the creating the mother block, a conductor that is to be the end surface electrode portion is disposed in each of the plurality of through-holes.

16. The wire-wound core manufacturing method according to claim 14, wherein the creating the mother block includes forming the plurality of first mother sheets by printing, and forming the plurality of second mother sheets on the plurality of first mother sheets by printing.

17. The wire-wound core manufacturing method according to claim 14, wherein in the creating the mother block, a conductor film that is to be the bottom surface electrode portion is disposed on a bottom surface of the second mother sheet located on a bottommost side among the plurality of second mother sheets, and wherein the conductor film is divided by either the x-direction division planes or the y-direction division planes.

18. The wire-wound core manufacturing method according to claim 14, further comprising:

forming, when a face opposite to the bottom surface is defined as a top surface and a face linking the bottom surface and the top surface to each other is defined as a lateral surface, through-holes in the plurality of first mother sheets and the plurality of second mother sheets such that the lateral surface of the core portion is made lower than the lateral surface of the first flange portion.

19. The wire-wound core manufacturing method according to claim 14, further comprising:

forming, when a face opposite to the bottom surface is defined as a top surface, a second groove on the mother block from a top surface side such that the top surface of the core portion is made lower than the top surface of the first flange portion.

20. The wire-wound core manufacturing method according to claim 14, further comprising:

forming a pattern conductor of a passive element on at least one of the pluralities of first and second mother sheets.

* * * * *